US011165186B2

(12) United States Patent
Hsu

(10) Patent No.: US 11,165,186 B2
(45) Date of Patent: Nov. 2, 2021

(54) COAXIAL CABLE CONNECTOR

(71) Applicant: EZCONN CORPORATION, New Taipei (TW)

(72) Inventor: Yu-hong Hsu, New Taipei (TW)

(73) Assignee: EZconn Corporation, New Taipei (TW)

( * ) Notice: Subject to any disclaimer, the term of this patent is extended or adjusted under 35 U.S.C. 154(b) by 0 days.

(21) Appl. No.: 17/094,838

(22) Filed: Nov. 11, 2020

(65) Prior Publication Data

US 2021/0066842 A1 Mar. 4, 2021

Related U.S. Application Data

(63) Continuation-in-part of application No. 16/393,933, filed on Apr. 24, 2019, now Pat. No. 10,855,004.

(51) Int. Cl.

| | |
|---|---|
| ***H01R 13/502*** | (2006.01) |
| ***H01R 24/40*** | (2011.01) |
| ***H01R 13/623*** | (2006.01) |
| ***H01R 103/00*** | (2006.01) |

(52) U.S. Cl.

CPC ..... *H01R 13/502* (2013.01); *H01R 13/623* (2013.01); *H01R 24/40* (2013.01); *H01R 2103/00* (2013.01)

(58) Field of Classification Search

CPC .. H01R 13/622; H01R 24/40; H01R 2103/00; H01R 9/0524; H01R 9/05; H01R 9/0521; H01R 43/26; H01R 24/38; H01R 9/0518; H01R 43/20; H01R 13/6592; H01R 2201/18

See application file for complete search history.

(56) References Cited

U.S. PATENT DOCUMENTS

| | | | | |
|---|---|---|---|---|
| 7,618,276 | B2 * | 11/2009 | Paglia | H01R 43/24 439/322 |
| 7,798,849 | B2 * | 9/2010 | Montena | H01R 13/622 439/583 |
| 8,016,605 | B2 * | 9/2011 | Montena | H01R 24/40 439/322 |
| 8,016,612 | B2 * | 9/2011 | Burris | H01R 43/26 439/578 |
| 8,029,315 | B2 * | 10/2011 | Purdy | H01R 13/6593 439/578 |
| 8,172,611 | B1 * | 5/2012 | Montena | H01R 13/6397 439/578 |
| 8,568,164 | B2 * | 10/2013 | Ehret | H01R 9/05 439/578 |

(Continued)

*Primary Examiner* — Renee S Luebke
*Assistant Examiner* — Matthew T Dzierzynski

(57) ABSTRACT

A coaxial cable connector comprising a sleeve, nut, post, and annular flange is provided. The post is assembled to the nut, the annular flange to the post, and post, annular flange and nut to the sleeve. The nut has a plurality of nut sides, and a plurality of crests between the plurality of nut sides, each having a raised ridged pattern thereon. Each raised ridged pattern comprises a first plurality of grooves having a first groove helix angle and a second plurality of grooves having a second groove helix angle, intersecting the first plurality of grooves, forming a plurality of peaks. Following assembly, a plurality of deformed indentations is formed on an inner surface of the sleeve via the plurality of peaks of the nut.

20 Claims, 19 Drawing Sheets

(56) References Cited

U.S. PATENT DOCUMENTS

| | | | | |
|---|---|---|---|---|
| 8,864,519 | B2 * | 10/2014 | Wei | H01R 13/405<br>439/578 |
| 9,837,777 | B1 * | 12/2017 | Blake | B25B 13/48 |
| 9,859,669 | B2 * | 1/2018 | Chen | H01R 24/40 |
| 9,929,498 | B2 * | 3/2018 | Thakare | H01R 13/622 |
| 10,855,004 | B2 * | 12/2020 | Hsu | H01R 9/0521 |

* cited by examiner

COAXIAL CABLE CONNECTOR

RELATED APPLICATIONS

The application is a continuation-in-part application of U.S. nonprovisional application Ser. No. 16/393,933, filed on Apr. 24, 2019, which claims the benefit of priority to Taiwan application no. 107205408, filed on Apr. 25, 2018, of which is incorporated herein by reference in its entirety.

BACKGROUND OF THE INVENTION

Field of the Invention

Example embodiments relate generally to the field of communications and data transmission and, more particularly, to coaxial cable connectors.

DESCRIPTION OF THE RELATED ART

TV service types are dominated by cord connected services. These cord connected services utilize coaxial cables for connection, employing connectors such as twistable F-type connectors. Twistable F-type connectors are used for connection with cable TV decoders, digital video recorders and DVD recorders, satellite receivers, video game systems, distribution amplifiers or signal splitters, and switching boxes etc., having a mounting means built therein.

Conventional coaxial cable connectors generally comprise a connector body having a post which is able to house a coaxial cable therethrough, a nut, rotatably coupled to the post, mounting the coaxial cable connector to a rack, casing, apparatus or device having a mounting means built therein, and an annular flange, between the post and nut.

An o-ring may also be placed between the post and nut at a rotatable portion therebetween, for waterproof sealing.

The post of the coaxial cable connectors, generally comprise a coaxial cable receiving end, receiving a coaxial cable therethrough and a coaxial cable connecting end, opposite thereto. The nut of the coaxial cable connectors, generally further comprise internal threads, at the coaxial cable connecting end, having a width compatible for mounting the coaxial cable connectors to an interface port of the rack, casing, apparatus or device having a mounting means built therein.

Conventional coaxial cable connectors may further comprise a sleeve, for securing the coaxial cable positioned within the connector body of the coaxial cable connector to the interface port. The sleeve is basically formed of an elastic plastic material and is slidably engaged to the connector body of the coaxial cable connector. However, often the coaxial cable connectors are not properly mounted to the interface port.

Over time, the coaxial cable connectors may not fully engage with and be tightened to the interface port. Thus, proper electrical mating of connector components with the interface port would not occur. After tightening, the coaxial cable connector may undergo complete or partial pretension loss caused by dynamic stresses resulting in the loosening or relative movements resulting in the unscrewing from the interface port, causing loss of component abutment and proper electrical mating.

The coaxial cable connectors may be over-tightened to the interface port. Thus, proper electrical mating of connector components with the interface port would also not occur. After being over-tightened, electrical mating may be faulty because the connector components are caused to yield and/or move out of proper physical connection with the interface port. This is generally more common for coaxial cable connectors not having o-rings placed between the post and nut at rotatable portions therebetween, where waterproof sealing may not be required for coaxial cable connectors being used indoors.

BRIEF SUMMARY OF THE INVENTION

In an embodiment, a coaxial cable connector comprising a sleeve, a nut, a post and an annular flange is provided. The sleeve has a proximal sleeve engagement portion surrounding a proximal sleeve interior opening and a distal sleeve interior portion surrounding a distal sleeve interior opening, wherein the proximal sleeve engagement portion comprises a proximal sleeve interior portion. The nut has a plurality of nut sides surrounding a distal nut interior opening, opposite a proximal nut interior opening, a plurality of crests between the plurality of nut sides, each having a raised ridged pattern thereon, and an annular inward protrusion having a protrusion ridge, a tapered protrusion surface, and an inner protrusion surface. Each raised ridged pattern comprises a first plurality of grooves having a first groove helix angle with respect to a reference plane normal to a longitudinal axis of the plurality of crests and a second plurality of grooves having a second groove helix angle with respect to the reference plane, intersecting the first plurality of grooves, forming a plurality of peaks. The post has a proximal post engagement portion surrounding a proximal post interior opening, proximal post outer surface, post ridge, post outer surface, and distal post tapered end surrounding a distal post interior opening. The annular flange has a proximal flange engagement end surrounding a proximal flange interior opening, proximal channel, first proximal outer surface, second proximal outer surface, a central outer annular flange, and a distal flange end surrounding a distal flange interior opening.

In the embodiment, the post is assembled to the nut via the proximal nut interior opening, whereby the proximal post engagement portion is near to the protrusion ridge of the nut. The annular flange is assembled to the post and the nut via the proximal flange interior opening of the annular flange. The proximal flange engagement end is flush with the annular inward protrusion of the nut and post ridge and post outer surface of the post, and an annular space is formed between the proximal flange engagement end and distal flange end of the annular flange and post outer surface and distal post tapered end of the post.

In the embodiment, the nut is assembled to the proximal sleeve interior portion of the sleeve via the distal sleeve interior opening. In some embodiments, the distal sleeve interior opening is polygonal-shaped. Following assembly, a plurality of deformed indentations is formed on an inner surface of the sleeve via the plurality of peaks of the nut.

In the embodiments, the depth of the plurality of peaks of the nut with respect to a reference plane of each respective plurality of crests is configured such that the nut may be conveniently slip-on assembled to the sleeve and following deformation of the inner surface of the sleeve via the plurality of peaks of the nut, the nut may be fixedly gripped and mounted to the sleeve, such that unmounting and/or rotational slippage due to, as an example, dynamic stresses or screwing and unscrewing of the coaxial cable connector is hindered. The depth is configured such that a greater amount of inner surface deformation is achieved, increasing ploughing friction, resulting in a higher friction value.

In some embodiments, each of the first and second plurality of grooves of the nut comprise a first groove surface, a second groove surface, and a groove line formed at each respective juncture of the first and second groove surfaces. In an alternative embodiment, the intersections of the first and second plurality of grooves form a plurality of pyramids on each of the plurality of crests of the nut, whereby each of the pyramids include first opposed side surfaces formed by the first groove surfaces and second opposed side surfaces formed by the second groove surfaces.

In some embodiments, the sum of the magnitudes of the first and second helix angles of the nut are less than 90° degrees, inclusive. In some embodiments, the magnitudes of the first and second helix angles of the nut are the same. In some embodiments, the magnitudes of the first and second helix angles of the nut are different. The magnitudes of the first and second helix angles determine the amount of the plurality of peaks of the nut and formation of the plurality of deformed indentations on the inner surface of the sleeve. The magnitudes are configured such that a greater amount of inner surface deformation is achieved, increasing ploughing friction, resulting in a higher friction value.

In some embodiments, the coaxial cable connector further comprises a fixing washer having a fixing washer ring and a plurality of fixing appendages. Each of the plurality of fixing appendages comprises an elastic wing and an opening space. The fixing washer is assembled to the proximal post engagement portion and proximal post outer surface of the post via the distal post tapered end. The elastic wing of each of the plurality of fixing appendages is in contact with the tapered protrusion surface of the nut. In an alternative embodiment, the plurality of fixing appendages are perpendicular to the fixing washer ring, and the elastic wing extends from a top portion of each of the plurality of fixing appendages at an outward angle. When the elastic wing of each of the plurality of fixing appendages are in contact with the tapered protrusion surface of the nut and the nut is moved, the outward angle thereof is varied.

In an embodiment, a nut, configured as a part of a coaxial cable connector, comprising a plurality of nut sides, a plurality of crests between the plurality of nut sides, and an annular inward protrusion is provided. The plurality of nut sides surrounds a distal nut interior opening, opposite a proximal nut interior opening. Each of the plurality of crests has a raised ridged pattern thereon. The annular inward protrusion has a protrusion ridge, a tapered protrusion surface, and an inner protrusion surface. Each raised ridged pattern comprises a first plurality of grooves having a first groove helix angle with respect to a reference plane normal to a longitudinal axis of the plurality of crests and a second plurality of grooves having a second groove helix angle with respect to the reference plane, intersecting the first plurality of grooves, forming a plurality of peaks.

The coaxial cable connector of the nut further comprises a sleeve, a post, an annular flange. The sleeve has a proximal sleeve engagement portion surrounding a proximal sleeve interior opening and a distal sleeve interior portion surrounding a distal sleeve interior opening. The proximal sleeve engagement portion comprises a proximal sleeve interior portion. The post has a proximal post engagement portion surrounding a proximal post interior opening, proximal post outer surface, post ridge, post outer surface, and distal post tapered end surrounding a distal post interior opening. The annular flange has a proximal flange engagement end surrounding a proximal flange interior opening, proximal channel, first proximal outer surface, second proximal outer surface, a central outer annular flange, and a distal flange end surrounding a distal flange interior opening.

In the embodiment of the nut, configured as a part of a coaxial cable connector, the post is assembled to the nut via the proximal nut interior opening, whereby the proximal post engagement portion is near to the protrusion ridge of the nut. The annular flange is assembled to the post and the nut via the proximal flange interior opening of the annular flange. The proximal flange engagement end is flush with the annular inward protrusion of the nut and post ridge and post outer surface of the post, and an annular space is formed between the proximal flange engagement end and distal flange end of the annular flange and post outer surface and distal post tapered end of the post. The nut is assembled to the proximal sleeve interior portion of the sleeve via the distal sleeve interior opening. In some embodiments, the distal sleeve interior opening is polygonal-shaped. Following assembly, a plurality of deformed indentations is formed on an inner surface of the sleeve via the plurality of peaks of the nut.

In the embodiments of the nut, the depth of the plurality of peaks of the nut with respect to a reference plane of each respective plurality of crests is configured such that the nut may be conveniently slip-on assembled to the sleeve and following deformation of the inner surface of the sleeve via the plurality of peaks of the nut, the nut may be fixedly gripped and mounted to the sleeve, such that unmounting and/or rotational slippage due to, as an example, dynamic stresses or screwing and unscrewing of the coaxial cable connector is hindered. The depth is configured such that a greater amount of inner surface deformation is achieved, increasing ploughing friction, resulting in a higher friction value.

In some embodiments of the nut, each of the first and second plurality of grooves of the nut comprise a first groove surface, a second groove surface, and a groove line formed at each respective juncture of the first and second groove surfaces. In an alternative embodiment, the intersections of the first and second plurality of grooves form a plurality of pyramids on each of the plurality of crests of the nut, whereby each of the pyramids include first opposed side surfaces formed by the first groove surfaces and second opposed side surfaces formed by the second groove surfaces.

In some embodiments of the nut, the sum of the magnitudes of the first and second helix angles of the nut are less than 90° degrees, inclusive. In some embodiments, the magnitudes of the first and second helix angles of the nut are the same. In some embodiments, the magnitudes of the first and second helix angles of the nut are different. The magnitudes of the first and second helix angles determine the amount of the plurality of peaks of the nut and formation of the plurality of deformed indentations on the inner surface of the sleeve. The magnitudes are configured such that a greater amount of inner surface deformation is achieved, increasing ploughing friction, resulting in a higher friction value.

In some embodiments of the nut, the coaxial cable connector further comprises a fixing washer having a fixing washer ring and a plurality of fixing appendages. Each of the plurality of fixing appendages comprises an elastic wing and an opening space. The fixing washer is assembled to the proximal post engagement portion and proximal post outer surface of the post via the distal post tapered end. The elastic wing of each of the plurality of fixing appendages is in contact with the tapered protrusion surface of the nut. In an alternative embodiment, the plurality of fixing appendages are perpendicular to the fixing washer ring, and the elastic wing extends from a top portion of each of the plurality of fixing appendages at an outward angle. When the elastic wing of each of the plurality of fixing appendages are in contact with the tapered protrusion surface of the nut and the nut is moved, the outward angle thereof is varied.

In an alternative embodiment, a coaxial cable connector comprising a sleeve, a nut, and a post is provided. The sleeve has a proximal sleeve engagement portion surrounding a proximal sleeve interior opening and a distal sleeve interior portion surrounding a distal sleeve interior opening. The proximal sleeve engagement portion comprises a proximal sleeve interior portion. The nut has a plurality of nut sides surrounding a distal nut interior opening, opposite a proximal nut interior opening, a plurality of engagement protrusions between the plurality of nut sides, and a distal annular inward protrusion. Each plurality of nut sides have ends forming a distal nut side surface. The distal annular inward protrusion has a proximal inner protrusion shoulder, an inner protrusion surface, and a distal inner protrusion surface flush with each of the distal nut side surfaces. The distal inner protrusion surface and each of the distal nut side surfaces define a distal nut base. Each of the plurality of engagement protrusions comprise a tapered side and a distal side, the tapered side, positioned toward the proximal nut interior opening, has an outer angle that is greater than an outer angle of the distal side. The post has a proximal post engagement portion surrounding a proximal post interior opening, a distal post tapered end surrounding a distal post interior opening, and a proximal annular outward protrusion between the proximal post engagement portion and distal post tapered end. The proximal annular outward protrusion has a proximal outward protrusion shoulder.

In the alternative embodiment of the coaxial cable connector, the post is assembled to the nut via the distal nut interior opening. The proximal outward protrusion shoulder is flush with the distal nut base and the proximal post engagement portion extends further than a reference plane normal to the proximal inner protrusion shoulder, wherein the proximal post engagement portion is annularly outwardly bent forming a proximal post rolled rim. The distal annular inward protrusion of the nut is between the proximal post rolled rim and proximal annular outward protrusion of the post. The nut is assembled to the proximal sleeve interior portion of the sleeve via the distal sleeve interior opening. Following assembly, a plurality of deformed indentations is formed on an inner surface of the sleeve via the plurality of engagement protrusions of the nut.

In some embodiments of the alternative embodiment of the coaxial cable connector, the angle of the tapered side of the plurality of engagement protrusions is between 105° degrees and 170° degrees, inclusive.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several examples of heatsink fins incorporating aspects of the presently disclosed principles are illustrated by way of example, and not by way of limitation.

DETAILED DESCRIPTION OF THE INVENTION

The following describes various principles related to communication and data transmission by way of reference to specific examples of coaxial cable connectors, including arrangements and examples of coaxial cable connector components embodying innovative concepts. More particularly, but not exclusively, such innovative principles are described in relation to selected examples of coaxial cable connectors, coaxial cable connector sleeves, and coaxial cable connector nuts and well-known functions or constructions are not described in detail for purposes of succinctness and clarity. Nonetheless, one or more of the disclosed principles can be incorporated in various other embodiments of coaxial cable connectors, coaxial cable connector sleeves, and coaxial cable connector nuts to achieve any of a variety of desired outcomes, characteristics, and/or performance criteria.

Thus, coaxial cable connectors, coaxial cable connector sleeves, and coaxial cable connector nuts having attributes that are different from those specific examples discussed herein can embody one or more of the innovative principles, and can be used in applications not described herein in detail. Accordingly, embodiments of coaxial cable connectors, coaxial cable connector sleeves, and coaxial cable connector nuts not described herein in detail also fall within the scope of this disclosure, as will be appreciated by those of ordinary skill in the relevant art following a review of this disclosure.

Example embodiments as disclosed herein are directed to communication and data transmission. In an embodiment, a coaxial cable connector comprising a sleeve, nut, post, and annular flange is provided. The post is assembled to the nut, the annular flange to the post, and post, annular flange and nut to the sleeve. The nut has a plurality of nut sides, and a plurality of crests between the plurality of nut sides, each having a raised ridged pattern thereon. Each raised ridged pattern comprises a first plurality of grooves having a first groove helix angle and a second plurality of grooves having a second groove helix angle, intersecting the first plurality of grooves, forming a plurality of peaks. Following assembly, a plurality of deformed indentations is formed on an inner surface of the sleeve via the plurality of peaks of the nut.

Figure 1A:
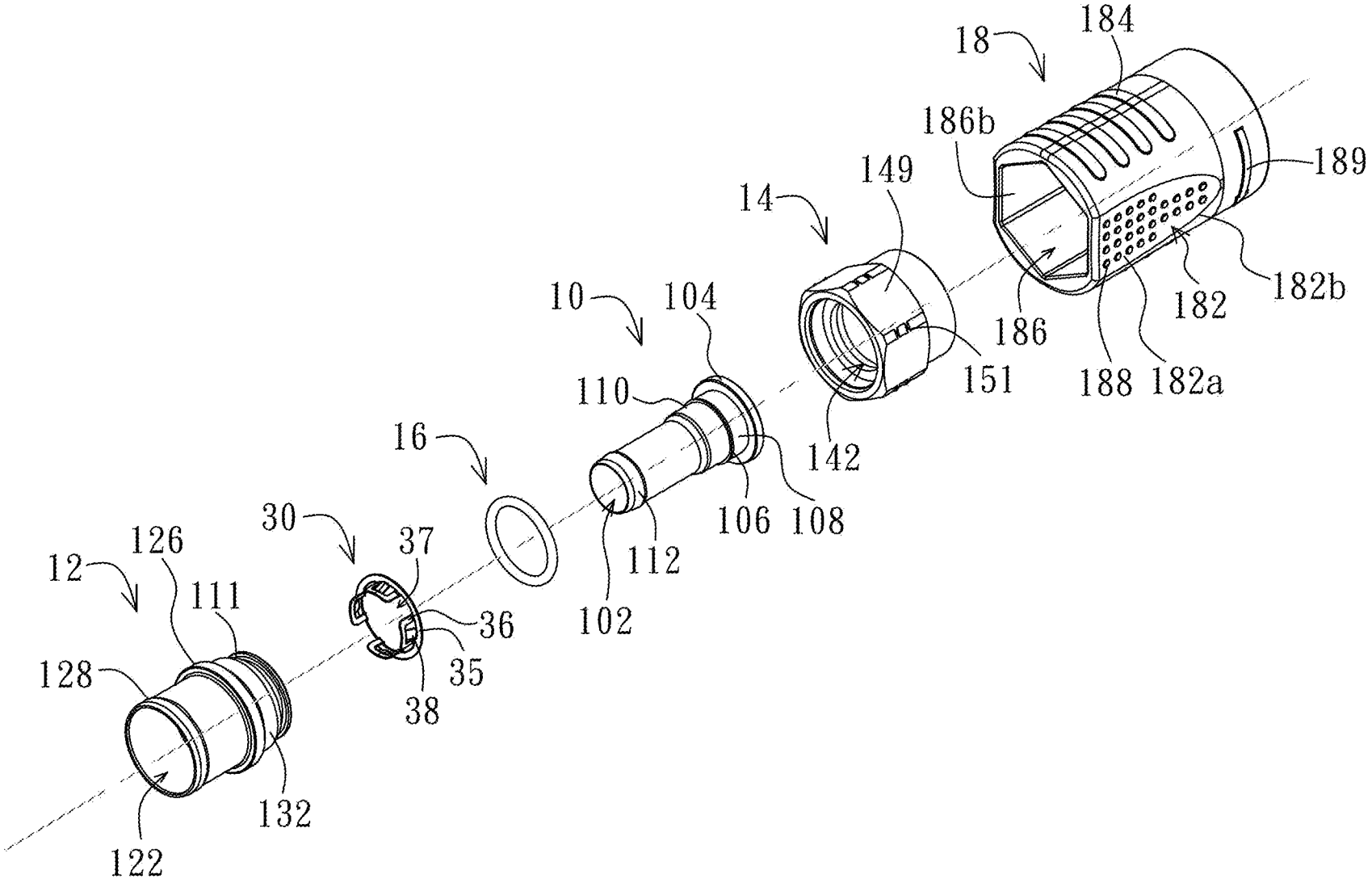
FIG. 1A is an exploded fifth view of a coaxial cable connector, according to an example embodiment.
Figure 1B:
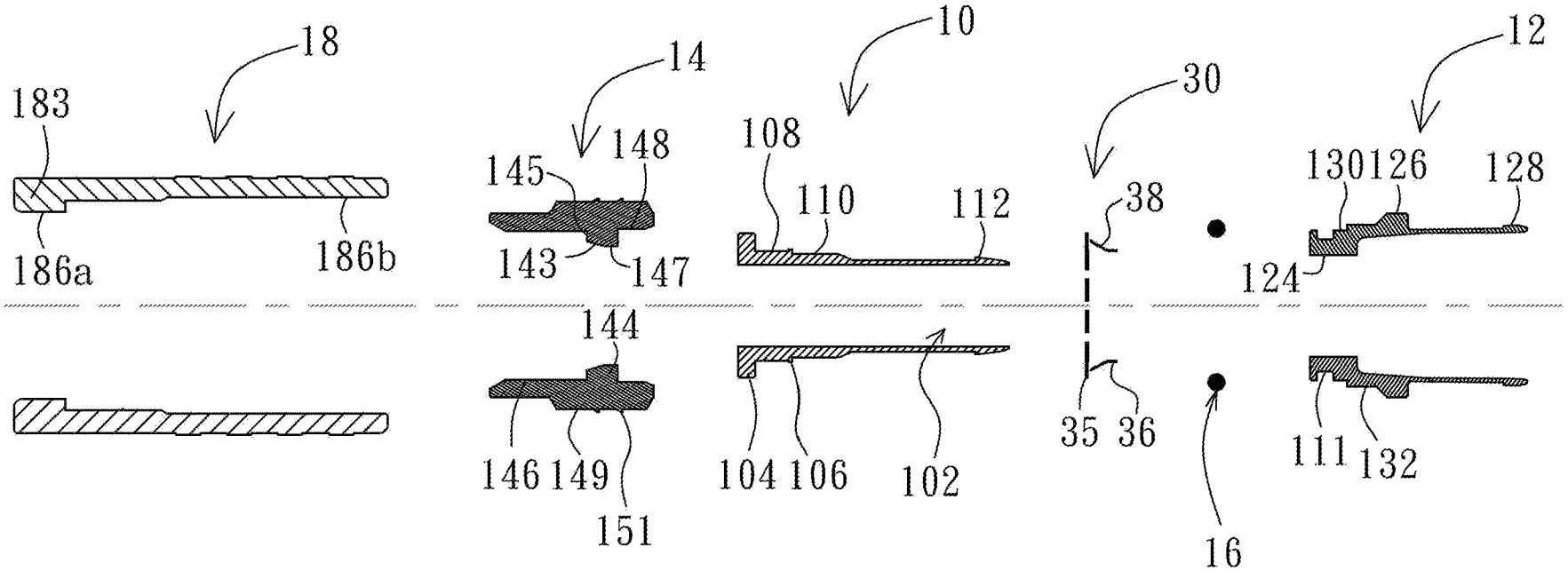
FIG. 1B is an exploded cross-sectional sliced first view of the coaxial cable connector of FIG. 1A, according to an example embodiment.
Figure 1D:
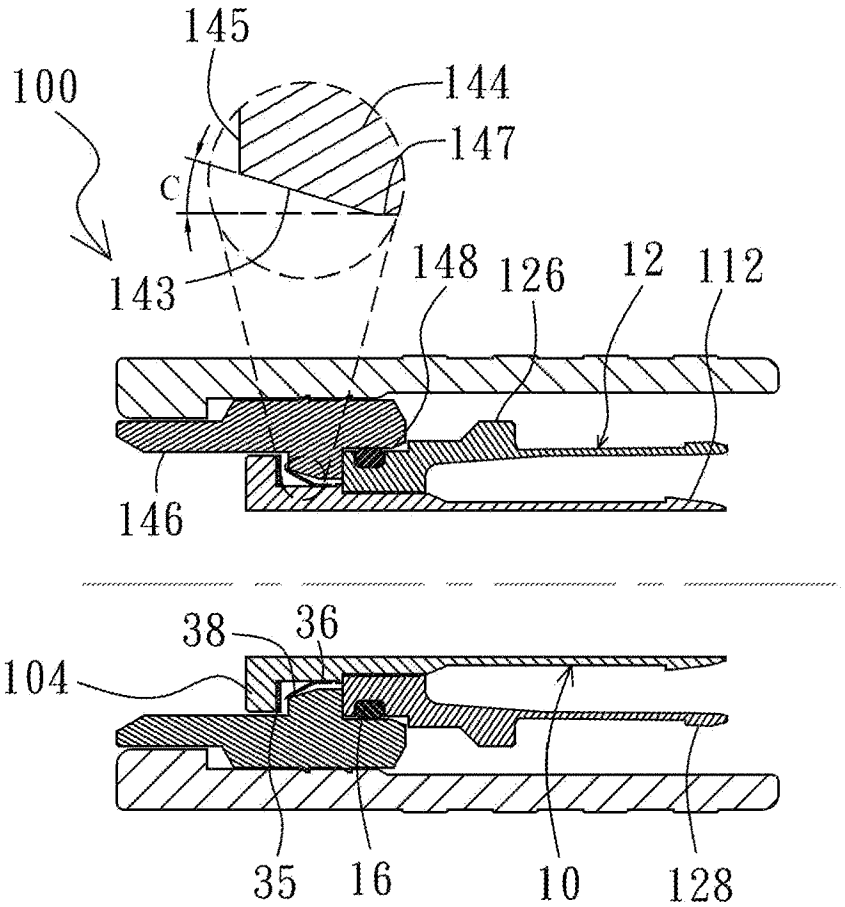
FIG. 1D is a cross-sectional sliced first view of the coaxial cable connector of FIG. 1A, according to an example embodiment.
Figure 1C:
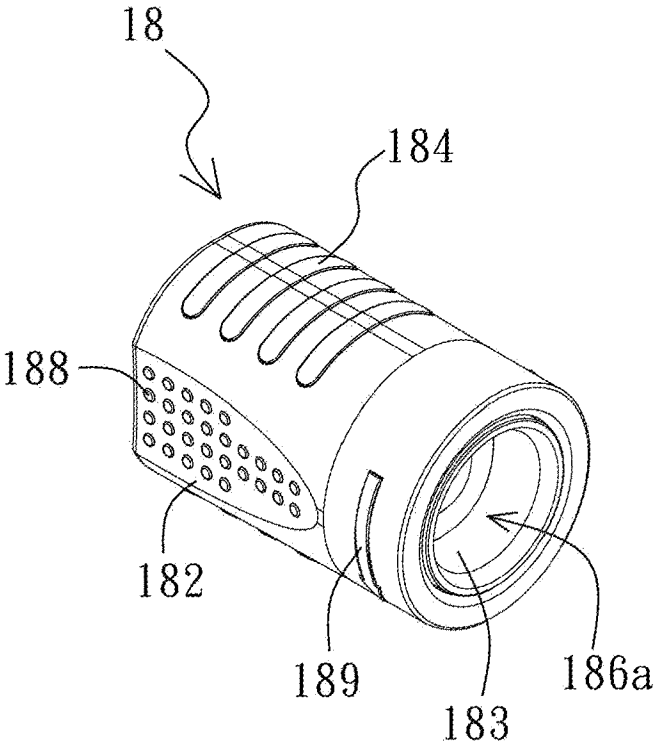
FIG. 1C is a schematic perspective sixth view of the coaxial cable connector of FIG. 1A, according to an example embodiment.

FIG. 1A is an exploded fifth view of a coaxial cable connector, according to an example embodiment. FIG. 1B is an exploded cross-sectional sliced first view of a coaxial cable connector, according to an example embodiment. FIG. 1C is a schematic perspective sixth view of a sleeve 18 of a coaxial cable connector, according to an example embodiment. FIG. 1D is a cross-sectional sliced first view of a coaxial cable connector, according to an example embodiment. As shown in FIGS. 1A to 1D, in an embodiment, a coaxial cable connector comprises a sleeve 18, nut 14, post 10, fixing washer 30, and annular flange 12. The post 10 has a proximal post engagement portion 104 surrounding a proximal post interior opening, proximal post outer surface 108, post ridge 106, post outer surface 110, and distal post tapered end 112 surrounding a distal post interior opening 102. The fixing washer 30 has a fixing washer ring 35 and a plurality of fixing appendages 36, wherein each of the plurality of fixing appendages 36 comprises an elastic wing 38 and an opening space 39. The nut 14 has a plurality of nut sides 149 surrounding a distal nut interior opening 142, opposite a proximal nut interior opening, and a plurality of engagement protrusions 151 between the plurality of nut sides 149.

In the embodiments, the diameter of the distal nut interior opening 142 is greater than the distal post tapered end 112 and post ridge 106, but smaller than the proximal post engagement portion 104.

In the embodiments, the thickness of the fixing washer ring 35, plurality of fixing appendages 36, and each elastic wing 38 is 0.05 to 0.50 millimetres or 0.03 to 1 millimetres.

In the embodiments, the fixing washer 30 further comprises a hollow interior 37 therethrough and the plurality of fixing appendages 36 and elastic wing 38 are integrally formed.

In the embodiments, the plurality of fixing appendages 36 of the fixing washer 30 has one elastic wing 38 and an opening space 39; however the embodiments are not limited thereto. In alternative embodiments, the plurality of fixing appendages 36 of the fixing washer 30 may have more than one elastic wing 38 and opening space 39. As an example, and not to be limiting, two to four elastic wings and opening spaces.

In the embodiments, the shape of the plurality of fixing appendages 36 is arch-shaped; however, the embodiments are not limited thereto. In alternative embodiments, the shape may be square-shaped, rectangular-shaped, semi-circular-shaped or polygonal shaped etc.

In the embodiments, the shape of the elastic wing 38 is arch-shaped; however, the embodiments are not limited thereto. In alternative embodiments, the shape may be square-shaped, rectangular-shaped, semi-circular-shaped or polygonal shaped etc.

In the embodiments, the surface of the elastic wing 38 may be smooth, rough, perforated, or the like etc.

In an embodiment, the nut 14 further comprises an annular inward protrusion 144 having a protrusion ridge 145, a tapered protrusion surface 143, and an inner protrusion surface 147.

In an embodiment, the nut 14 further comprises a distal nut end portion 148 and a threaded portion 146. The annular inward protrusion 144 is between the distal nut end portion 148 and a threaded portion 146.

In the embodiments, the type of the nut may be hex nuts, square nuts, ring nut, wing nuts, or the like, so long as manual or assisted twisting can be applied to mount the coaxial cable connector to a rack, casing, apparatus or device having a mounting means built therein.

In the embodiment, the fixing washer 30 is assembled to the proximal post engagement portion 104 and proximal post outer surface 108 of the post 10 via the distal post tapered end 112 and the post 10 and the fixing washer 30 are assembled to the nut 14 via the proximal nut interior opening. When assembled, the proximal post engagement portion 104 of the post 10 is near to the protrusion ridge 145 of the nut 14 and the elastic wing 38 of each of the plurality of fixing appendages 36 is in contact with the tapered protrusion surface 143 of the nut 14.

In the embodiments, the nut 14 is rotatable when in contact with the elastic wing 38 of each of the plurality of fixing appendages 36 and post ridge 106 of the post 10, and when the elastic wing 38 of each of the plurality of fixing appendages 36 is assembled to the proximal post engagement portion 104 and proximal post outer surface 108 of the post 14.

In the embodiments, an angle C, formed between the plane of the protrusion surface 147 and tapered protrusion surface 143, may be between 15° degrees to 60° degrees, between 10° degrees to 30° degrees, or between 20° degrees to 45° degrees, inclusive, respectfully.

Figure 2C:
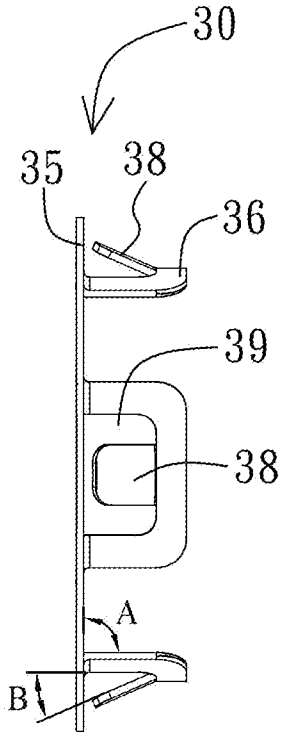
FIG. 2C is a schematic perspective first view of the fixing washer of FIG. 2A, according to an example embodiment.
Figure 2B:
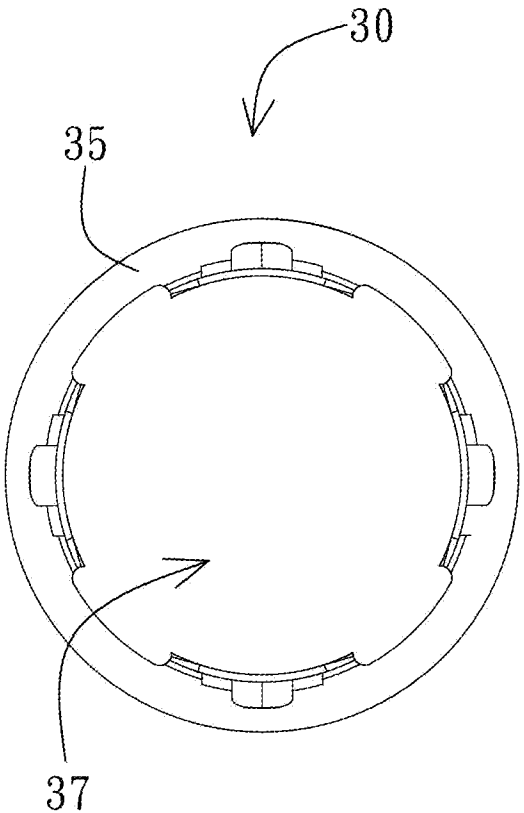
FIG. 2B is a schematic perspective seventh view of the fixing washer of FIG. 2A, according to an example embodiment.
Figure 2A:
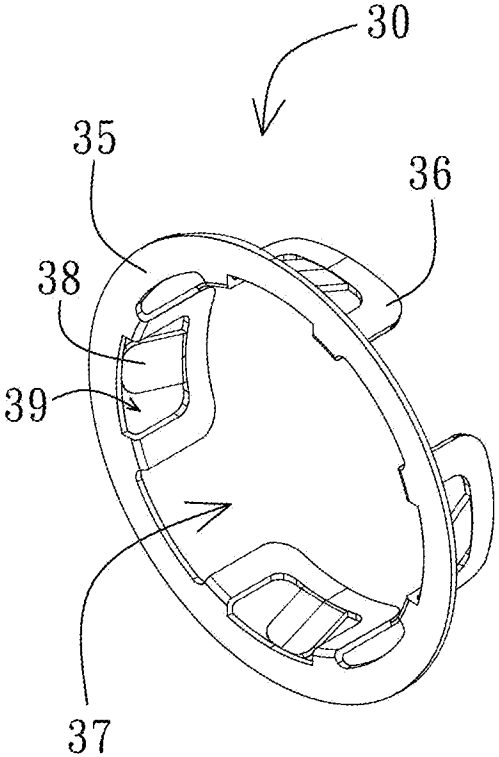
FIG. 2A is a schematic perspective third view of a fixing washer of a coaxial cable connector, according to an example embodiment.

FIG. 2A is a schematic perspective third view of a fixing washer of a coaxial cable connector, according to an example embodiment. FIG. 2B is a schematic perspective seventh view of the fixing washer of FIG. 2A, according to an example embodiment. FIG. 2C is a schematic perspective first view of the fixing washer of FIG. 2A, according to an example embodiment. As shown in FIGS. 2A to 2B, and referring to FIGS. 1A to 1D, in an alternative embodiment, the plurality of fixing appendages 36 is perpendicular to the fixing washer ring 35; however, the embodiments are not limited thereto. In other alternative embodiments, the plurality of fixing appendages 36 may be at a predetermined angle A, such as between 90° degrees to 120° degrees, between 90° degrees to 100° degrees, or between 90° degrees to 95° degrees. In the embodiment, the plurality of fixing appendages 36 are separated by a space and the elastic wing 38 extends from a top portion of each of the plurality of fixing appendages 36 at an outward angle. When the fixing washer 30 is assembled to the post 10, the elastic wing 38 of each of the plurality of fixing appendages 36 are in contact with the tapered protrusion surface 143 of the nut 14, and when the nut 14 is moved, the outward angle of the elastic wing 38 is varied.

In the embodiments, the angle of the arch of the separated spaces of the plurality of fixing appendages 36 may be between 10° degrees to 30° degrees, between 20° degrees to 45° degrees, between 60° degrees to 150° degrees, or between 60° degrees to 120° degrees, inclusive, respectfully.

Figure 3:
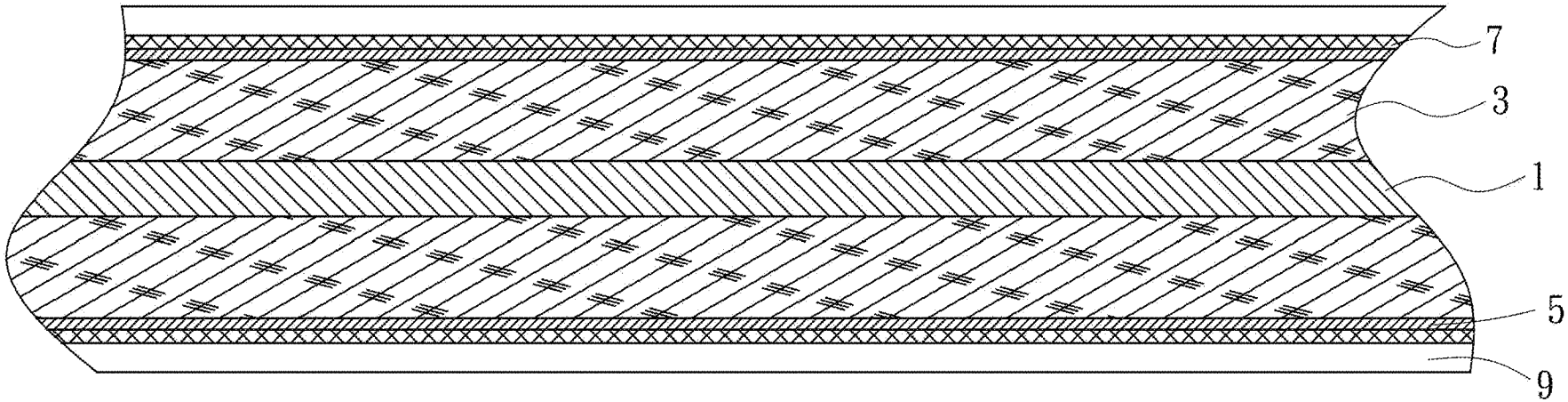
FIG. 3 is a cross-sectional first view of a coaxial cable, according to an example embodiment.

FIG. 3 is a cross-sectional first view of a coaxial cable, according to an example embodiment. As shown in FIG. 3, the coaxial cable comprises a center conductor 1, dielectric 3, foil shield 5, braided shield 7, and jacket 9. In the embodiments, the material of the center conductor 1 may comprise copper, bismuth, silver, nickel, tin, gold, copper gold-alloy, copper tin-alloy, copper nickel-alloy, or good electrically conductive polymer, or non-metal conductors etc. In the embodiments, the material of the foil shield 5 may comprise an aluminum-containing metal layer, copper-containing metal layer, or conductive material-containing conductive layer, such as aluminum foil coatings, or copper foil coatings. The foil shield 5 has electrical shielding effect to reduce electrical interference. In the embodiments, the type of braided shield 7 may be a combination shield, tri-shield, or quad-shield etc. and the material of the braided shield 7 may be aluminum, aluminum-alloy, copper, or copper-alloy.

Figure 4B:
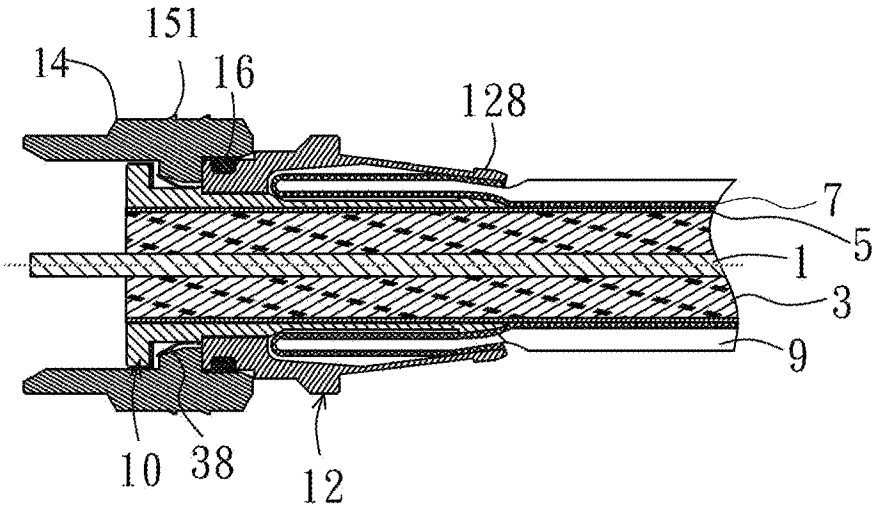
FIG. 4B is a cross-sectional sliced first view of the coaxial cable connector of FIG. 4A without a sleeve, according to an example embodiment.
Figure 4A:
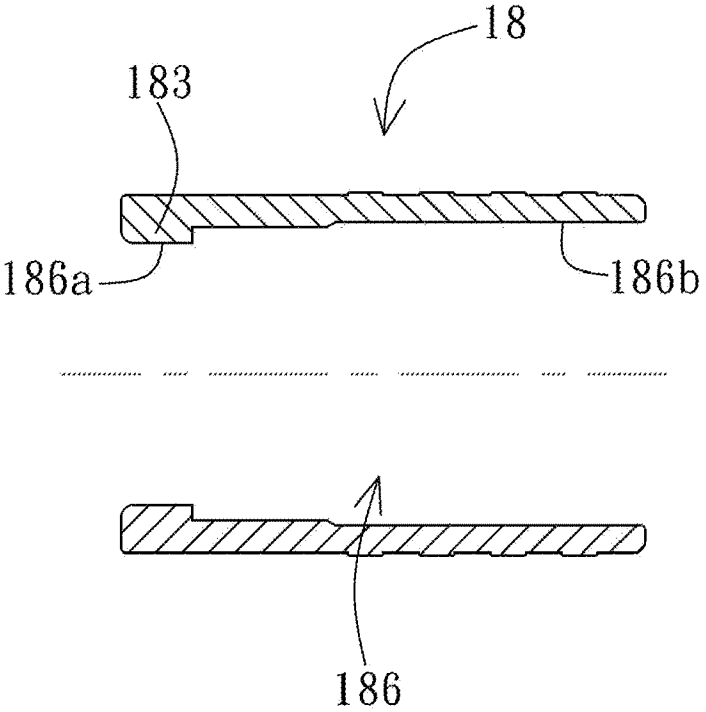
FIG. 4A is a cross-sectional sliced first view of a sleeve of a coaxial cable connector, according to an example embodiment.
Figure 4C:
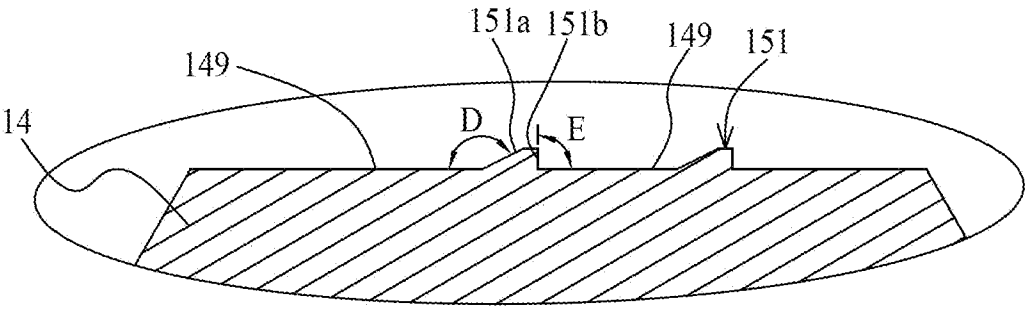
FIG. 4C is a cross-sectional enlarged first view of a plurality of engagement protrusions of the nut of the coaxial cable connector of FIG. 4B, according to an example embodiment.
Figure 4D:
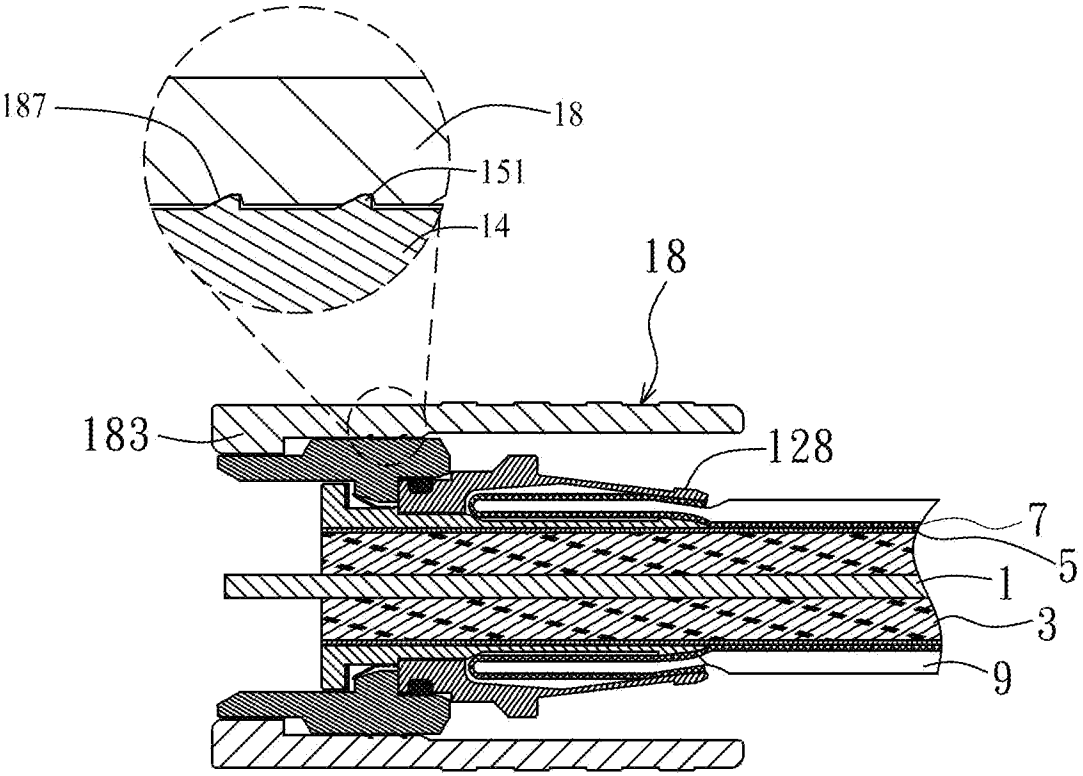
FIG. 4D is a cross-sectional sliced first view of the coaxial cable connector of FIG. 4A, according to an example embodiment.

FIG. 4A is a cross-sectional sliced first view of a sleeve of a coaxial cable connector, according to an example embodiment. FIG. 4B is a cross-sectional sliced first view of the coaxial cable connector of FIG. 4A without a sleeve, according to an example embodiment. FIG. 4C is a cross-sectional enlarged first view of a plurality of engagement protrusions of the nut of the coaxial cable connector of FIG. 4B, according to an example embodiment. FIG. 4D is a cross-sectional sliced first view of the coaxial cable connector of FIG. 4A, according to an example embodiment. As shown in FIGS. 4A to 4D, and referring to FIGS. 1A to 1D, in the embodiment, each of the plurality of engagement protrusions 151 comprise a tapered side 151*a* and a distal side 151*b*, the tapered side 151*a*, positioned toward the proximal nut interior opening, has an outer angle D that is greater than an outer angle E of the distal side 151*b*. The annular flange 12 has a proximal flange engagement end 124 surrounding a proximal flange interior opening, proximal channel 111, first proximal outer surface 130, second proximal outer surface 132, a central outer annular flange 126, and a distal flange end 128 surrounding a distal flange interior opening 122. The sleeve 18 has a proximal sleeve engagement portion 183 surrounding a proximal sleeve interior opening and a distal sleeve interior portion 186*b* surrounding a distal sleeve interior opening 186. The proximal sleeve engagement portion 183 comprises a proximal sleeve interior portion 186*a*.

In an alternative embodiment, the coaxial cable connector further comprises an o-ring 16 assembled within the proximal channel 111 of the annular flange 12 for waterproof sealing. When assembled, the o-ring 16 completely encompasses all of the space of the proximal channel 111 of the annular flange 12, and is deformed due the pressure from the distal nut end portion 148 of the nut 14. Material of the o-ring 16 may comprise rubber material, soft polymaterial, other elastic and waterproof sealing polymaterial, or the like etc.

In the embodiments, when assembled, a proximal portion of the jacket 9 is removed and the center conductor 1, dielectric 3, and foil shield 5 is inserted into the distal post tapered end 112 of the post 10. The center conductor 1 extends flush with the proximal nut interior opening surrounded by the threaded portion 146 of the nut 14. The dielectric 3 and foil shield 5 lies flush with the proximal post interior opening surrounded by the proximal post engagement portion 104. During assembly, a lengthier portion of the braided shield 7 is folded backward to cover a portion of the jacket 9 corresponding to the annular space formed between the proximal flange engagement end 124 and distal flange end 128 of the annular flange 12 and post outer surface 110 and distal post tapered end 112 of the post 10, following a force applied to the distal flange end 128 of the annular flange 12 via assembly to the post 10 and nut 14.

In the embodiments, the tapered side 151*a* of each of the plurality of engagement protrusions 151 of the nut 14 is positioned toward the proximal nut interior opening, and has an outer angle D that is greater than an outer angle E of the distal side 151*b* of each of the plurality of engagement protrusions 151. Due to the smaller diameter of the proximal sleeve interior portion 186*a* of the sleeve 18 in relation to the plurality of nut sides 149 and the outer angles of the tapered and distal sides 151*a*, 151*b*, when the nut 14 is assembled to the sleeve 18 via the distal sleeve interior opening 186 of the sleeve 18, the main direction of assembly is assured to be from the tapered side 151*a* of each of the plurality of engagement protrusions 151 of the nut 14, positioned toward the proximal nut interior opening, and not the distal side 151*b*.

In the embodiments, the shape of the tapered and distal sides 151*a*, 151*b* of the plurality of engagement protrusions 151 is triangular prism-shaped; however, the embodiments are not limited thereto. The shape of the tapered and distal sides 151*a*, 151*b* of the plurality of engagement protrusions 151 may be conical-shaped, triangular-shaped, hook-shaped, square, convex-shaped or the like.

In the embodiments, the outer angle D of the tapered side 151*a* of the plurality of engagement protrusions 151, positioned toward the proximal nut interior opening, may be between 90° degrees to 160° degrees, between 105° degrees to 170° degrees, between 120° degrees to 150° degrees, and between 110° degrees to 150° degrees, inclusive, respectfully. The outer angle E of the distal side 151*b* of the plurality of engagement protrusions 151 may be between 0° degrees to 90° degrees, between 20° degrees to 80° degrees, between 30° degrees to 60° degrees, and between 40° degrees to 60° degrees, inclusive, respectfully.

Figure 5:
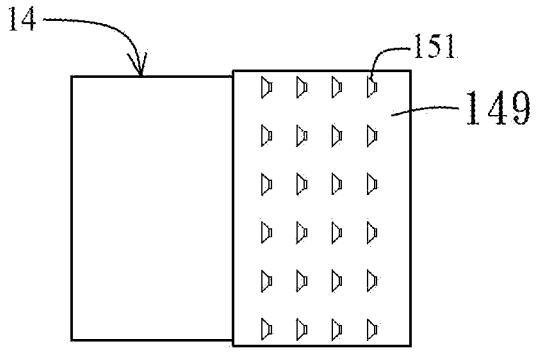
FIG. 5 is a schematic perspective second view of an alternative nut of a coaxial cable connector, according to an example embodiment.
Figure 6:
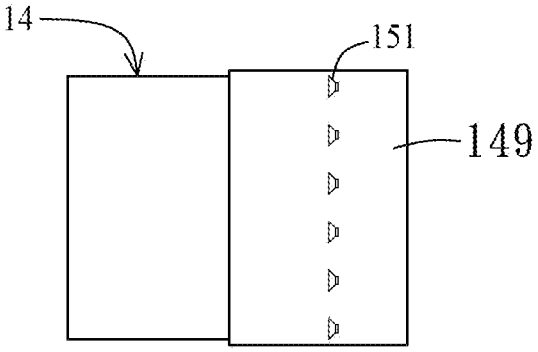
FIG. 6 is a schematic perspective second view of another alternative nut of a coaxial cable connector, according to an example embodiment.

FIG. 5 is a schematic perspective second view of an alternative nut of a coaxial cable connector, according to an example embodiment. FIG. 6 is a schematic perspective second view of another alternative nut of a coaxial cable connector, according to an example embodiment. As shown in FIGS. 5 and 6, as an example and not to be limiting, when the nut 14 is a conical nut, the plurality of engagement protrusions 151, comprising the tapered and distal sides 151*a*, 151*b*, the tapered side 151*a*, positioned toward the proximal nut interior opening, having an outer angle D that is greater than an outer angle E of the distal side 151*b*, may be annularly positioned along the circumference of the nut 14. In the embodiments, one or four sets of annularly positioned plurality of engagement protrusions 151 may be employed; however, the embodiments are not limited thereto. Any number of sets may be employed, continuously, or non-continuously, in any arrangement, so long as the indentations 187 are formed on the inner surface of the sleeve 18 via the plurality of engagement protrusions 151 of the nut 14.

In another alternative embodiment, the angle of the tapered side of the plurality of engagement protrusions 151 is between 105° degrees to 170° degrees.

In an alternative embodiment, the distal sleeve interior opening 186 is polygonal-shaped. In another alternative embodiment, the sleeve 18 further comprises a direction indicator 189 disposed on an outer surface of the proximal sleeve engagement portion 183.

In the embodiment, the annular flange 12 is assembled to the post 10, having the fixing washer 30 assembled thereto, and assembled to the nut 14, via the proximal flange interior opening. The post 10, fixing washer 30, nut 14 and annular flange 12, are assembled to the proximal sleeve interior portion 186*a* of the sleeve 18 via the distal sleeve interior opening 186. When assembled, the proximal flange engagement end 124 is tightly flush with the annular inward protrusion 144 of the nut 14 and post ridge 106 and post outer surface 110 of the post 10. An annular space is formed between the proximal flange engagement end 124 and distal flange end 128 of the annular flange 12 and post outer surface 110 and distal post tapered end 112 of the post 10. A plurality of deformed indentations 187 is formed on an inner surface of the sleeve 18 via the plurality of engagement protrusions 151 of the nut 14.

In the embodiments, the coaxial cable connector comprises the fixing washer 30; however, the embodiments are not limited thereto. In an alternative embodiment, the coaxial cable connector comprises a sleeve 18, nut 14, post 10, and annular flange 12, and not the fixing washer 30, wherein the disposition and assembly of the post 10 to the nut 14, annular flange 12 to the post 10 and nut 14, and post 10, nut 14, and annular flange 12 to the sleeve 18, is as described previously, without the description of the fixing washer 30. As an example, in the embodiment, with no fixing washer 30 assembled to the proximal post engagement portion 104 and proximal post outer surface 108 of the post 10, the post 10, alone, is assembled to the nut 14 via the proximal nut interior opening. When assembled, the proximal post engagement portion 104 of the post 10 is near to a protrusion ridge 145 of the nut 14 and the tapered protrusion surface 143 of the nut 14.

In an embodiment, a nut 14, configured as a part of a coaxial cable connector, comprising a plurality of nut sides 149 and a plurality of engagement protrusions 151 is provided. The plurality of nut sides 149 surrounds a distal nut interior opening 142, opposite a proximal nut interior opening. The plurality of engagement protrusions 151 are between the plurality of nut sides 149. Each of the plurality of engagement protrusions 151 comprises a tapered side 151*a* and a distal side 151*b*. The tapered side 151*a*, positioned toward the proximal nut interior opening, has an outer angle D that is greater than an outer angle E of the distal side 151*b*.

In the embodiment, the coaxial cable connector further comprises a sleeve 18, post 10, fixing washer 30, and annular flange 12. The post 10 has a proximal post engagement portion 104 surrounding a proximal post interior opening, proximal post outer surface 108, post ridge 106, post outer surface 110, and distal post tapered end 112 surrounding a distal post interior opening 102. The fixing washer 30 has a fixing washer ring 35 and a plurality of fixing appendages 36, wherein each of the plurality of fixing appendages 36 comprises an elastic wing 38 and an opening space 39.

In the embodiment, the fixing washer 30 is assembled to the proximal post engagement portion 104 and proximal post outer surface 108 of the post 10 via the distal post tapered end 112 and the post 10 and the fixing washer 30 are assembled to the nut 14 via the proximal nut interior opening. When assembled, the proximal post engagement portion 104 of the post 10 is near to a protrusion ridge 145 of the nut 14 and the elastic wing 38 of each of the plurality of fixing appendages 36 is in contact with the tapered protrusion surface 143 of the nut 14.

In an alternative embodiment, the plurality of fixing appendages 36 are perpendicular to the fixing washer ring 35, and the elastic wing 38 extends from a top portion of each of the plurality of fixing appendages 36 at an outward angle. Referring to FIGS. 2A to 2C, in alternative embodiments, the outward angle B of each of the extended elastic wing 38 of the plurality of fixing appendages 36 may be between 10° degrees to 20° degrees, between 15° degrees to 60° degrees, between 20° degrees to 25° degrees, and between 30° degrees to 75° degrees, inclusive, respectfully. Referring to FIGS. 1A to 1D, FIGS. 2A to 2C and 4A to 4D, when the fixing washer 30 is assembled to the post 10, the elastic wing 38 of each of the plurality of fixing appendages 36 are in contact with the tapered protrusion surface 143 of the nut 14, and when the nut 14 is moved, the outward angle of the elastic wing 38 is varied.

In the embodiment, the nut 14 further comprises an annular inward protrusion 144 having a protrusion ridge 145, a tapered protrusion surface 143, and an inner protrusion surface 147. The annular flange 12 has a proximal flange engagement end 124 surrounding a proximal flange interior opening, proximal channel 111, first proximal outer surface 130, second proximal outer surface 132, a central outer annular flange 126, and a distal flange end 128 surrounding a distal flange interior opening 122. The sleeve 18 has a proximal sleeve engagement portion 183 surrounding a proximal sleeve interior opening and a distal sleeve interior portion 186*b* surrounding a distal sleeve interior opening 186. The proximal sleeve engagement portion 183 comprises a proximal sleeve interior portion 186*a*.

In an alternative embodiment, the shape of the tapered and distal sides 151*a*, 151*b* of the plurality of engagement protrusions 151 is triangular prism-shaped. In another alternative embodiment, the angle of the tapered side of the plurality of engagement protrusions 151 is between 105° degrees and 170° degrees, inclusive, respectfully.

In an alternative embodiment, the distal sleeve interior opening 186 is polygonal-shaped.

In the embodiment, the annular flange 12 is assembled to the post 10, having the fixing washer 30 assembled thereto, and assembled to the nut 14, via the proximal flange interior opening. The post 10, fixing washer 30, nut 14 and annular flange 12, are assembled to the proximal sleeve interior portion 186*a* of the sleeve 18 via the distal sleeve interior opening 186. When assembled, the proximal flange engagement end 124 is tightly flush with the annular inward protrusion 144 of the nut 14 and post ridge 106 and post outer surface 110 of the post 10. An annular space is formed between the proximal flange engagement end 124 and distal flange end 128 of the annular flange 12 and post outer surface 110 and distal post tapered end 112 of the post 10. A plurality of deformed indentations 187 is formed on an inner surface of the sleeve 18 via the plurality of engagement protrusions 151 of the nut 14.

In the embodiments, the coaxial cable connector comprises the fixing washer 30; however, the embodiments are not limited thereto. In an alternative embodiment of the nut 14, configured as a part of a coaxial cable connector, the coaxial cable connector comprises a sleeve 18, nut 14, post 10, and annular flange 12, and not the fixing washer 30, wherein the disposition and assembly of the post 10 to the nut 14, annular flange 12 to the post 10 and nut 14, and post 10, nut 14, and annular flange 12 to the sleeve 18, is as described previously, without the description of the fixing washer 30. As an example, in the embodiment, with no fixing washer 30 assembled to the proximal post engagement portion 104 and proximal post outer surface 108 of the post 10, the post 10, alone, is assembled to the nut 14 via the proximal nut interior opening. When assembled, the proximal post engagement portion 104 of the post 10 is near to a protrusion ridge 145 of the nut 14 and the tapered protrusion surface 143 of the nut 14.

In an embodiment, a sleeve 18, configured as a part of a coaxial cable connector, comprising a proximal sleeve engagement portion 183, distal sleeve interior portion 186*b*, first conical flat surface 182, second conical flat surface, first semi-arching surface, and second semi-arching surface is provided. The proximal sleeve engagement portion 183 surrounds a proximal sleeve interior opening, having a proximal sleeve interior portion 186*a*. The distal sleeve interior portion 186*b* surrounds a polygonal-shaped distal sleeve interior opening 186. The first conical flat surface 182 has a plurality of first bumps 188 thereon. The second conical flat surface, opposite the first conical flat surface 182, has a plurality of second bumps thereon. A first semi-arching surface between the first and second conical flat surfaces has a plurality of first semi-curved protrusions 184 thereon. The second semi-arching surface, opposite the first semi-arching surface, has a plurality of second semi-curved protrusions thereon.

In the embodiments, the sleeve 18 is integrally formed.

In the embodiments, the shape of the distal sleeve interior portion 186*b* surrounding the distal sleeve interior opening 186 corresponds to the polygonal-shaped head of the nut 14; however, the embodiments are not limited thereto. If the nut 14 is a hex nut, square nut, ring nut, wing nut, or the like, the shape of the distal sleeve interior portion 186*b* surrounding the distal sleeve interior opening 186 would correspond to the appropriate shape of the head of the hex nut, square nut, ring nut, wing nut, or the like, respectively. So long as a plurality of deformed indentations is formed on an inner surface of the sleeve 18 via the nut and the nut may be conveniently slip-on assembled to the sleeve 18 and following deformation of the inner surface of the sleeve 18, the nut may be fixedly gripped and mounted to the sleeve, such that unmounting and/or rotational slippage due to, as an example, dynamic stresses or screwing and unscrewing of the coaxial cable connector is hindered.

In the embodiment, the coaxial cable connector further comprises a nut 14, a post 10, and an annular flange 12. The nut 14 has a plurality of nut sides 149 surrounding a distal nut interior opening 142, opposite a proximal nut interior opening, and a plurality of engagement protrusions 151 between the plurality of nut sides 149. Each of the plurality of engagement protrusions 151 comprises a tapered side 151*a* and a distal side 151*b*. The tapered side 151*a*, positioned toward the proximal nut interior opening, has an outer angle D that is greater than an outer angle E of the distal side 151*b*.

In an alternative embodiment, the nut 14 has a plurality of nut sides 149 surrounding a distal nut interior opening 142, opposite a proximal nut interior opening, and a plurality of engagement protrusions 151 between the plurality of nut sides 149. Each of the plurality of engagement protrusions 151 comprises a tapered side 151*a* and a distal side 151*b*. The tapered side 151*a*, positioned toward the proximal nut interior opening, has an outer angle D that is greater than an outer angle E of the distal side 151*b*. In another alternative embodiment, the shape of the tapered and distal sides 151*a*, 151*b* of the plurality of engagement protrusions 151 is triangular prism-shaped.

In the embodiment, the post 10 has a proximal post engagement portion 104 surrounding a proximal post interior opening, proximal post outer surface 108, post ridge 106, post outer surface 110, and distal post tapered end 112 surrounding a distal post interior opening 102. The annular flange 12 has a proximal flange engagement end 124 surrounding a proximal flange interior opening, proximal channel 111, first proximal outer surface 130, second proximal outer surface 132, a central outer annular flange 126, and a distal flange end 128 surrounding a distal flange interior opening 122. In an embodiment, the nut 14 further comprises an annular inward protrusion 144 having a protrusion ridge 145, a tapered protrusion surface 143, and an inner protrusion surface 147.

In the embodiment, the post 10 is assembled to the nut 14 via the proximal nut interior opening. When assembled, the proximal post engagement portion 104 is near to a protrusion ridge 145 of the nut 14. The annular flange 12 is assembled to the post 10 and the nut 14 via the proximal flange interior opening of the annular flange 12. When assembled, the proximal flange engagement end 124 is tightly flush with the annular inward protrusion 144 of the nut 14 and post ridge 106 and post outer surface 110 of the post 10. An annular space is formed between the proximal flange engagement end 124 and distal flange end 128 of the annular flange 12 and post outer surface 110 and distal post tapered end 112 of the post 10. The nut 14, post 10, and annular flange 12 are assembled to the proximal sleeve interior portion 186*a* of the sleeve 18 via the distal sleeve interior opening 186. Following assembly, a plurality of deformed indentations 187 is formed on an inner surface of the sleeve 18 via the plurality of engagement protrusions 151 of the nut 14.

Figure 7:
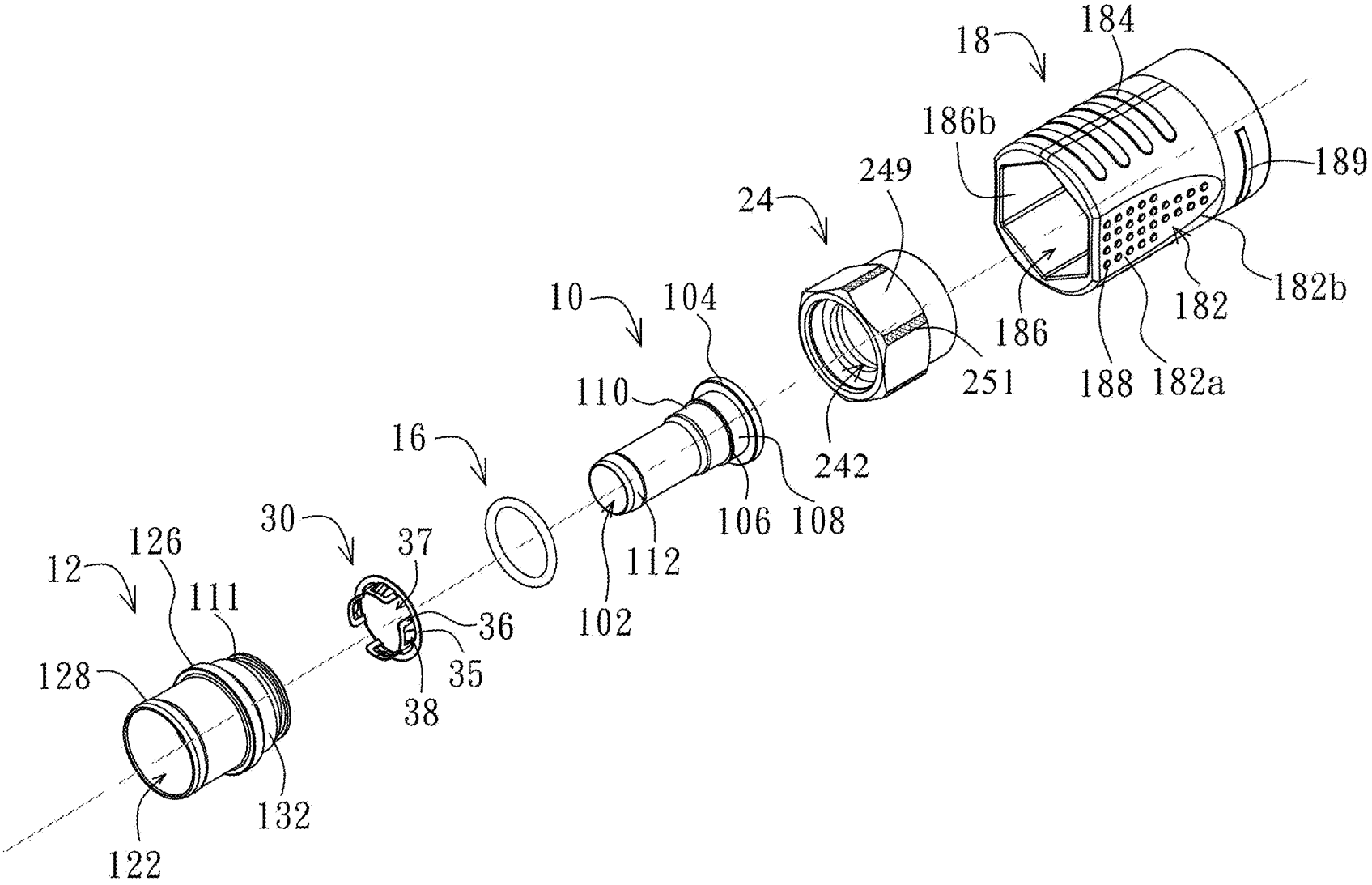
FIG. 7 is an exploded fifth view of an alternative coaxial cable connector, according to an example embodiment.

FIG. 7 is an exploded fifth view of an alternative coaxial cable connector, according to an example embodiment. Referring to FIG. 7, and referring to FIGS. 1A to 3, in the alternative embodiment, a coaxial cable connector, comprises the sleeve 18, the post 10 and the annular flange 12 of FIGS. 1A to 3, and yet another alternative nut 24. The sleeve 18 has a proximal sleeve engagement portion 183 surrounding a proximal sleeve interior opening and a distal sleeve interior portion 186*b* surrounding a distal sleeve interior opening 186. The proximal sleeve engagement portion 183 comprises a proximal sleeve interior portion 186*a*. The post 10 has a proximal post engagement portion 104 surrounding a proximal post interior opening, proximal post outer surface 108, post ridge 106, post outer surface 110, and distal post tapered end 112 surrounding a distal post interior opening 102. The annular flange 12 has a proximal flange engagement end 124 surrounding a proximal flange interior opening, proximal channel 111, first proximal outer surface 130, second proximal outer surface 132, a central outer annular flange 126, and a distal flange end 128 surrounding a distal flange interior opening 122.

Figure 8A:
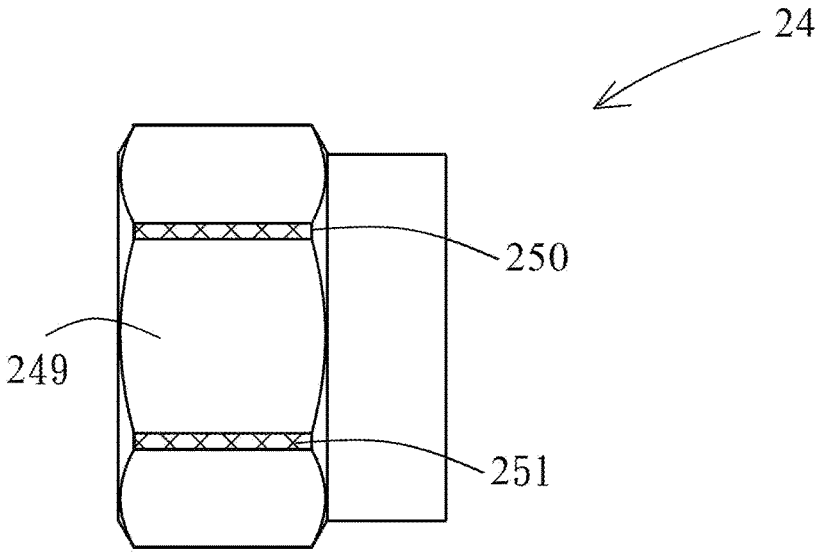
FIG. 8A is a schematic perspective second view of the yet another alternative nut of the alternative coaxial cable connector of FIG. 7, according to an example embodiment.
Figure 8B:
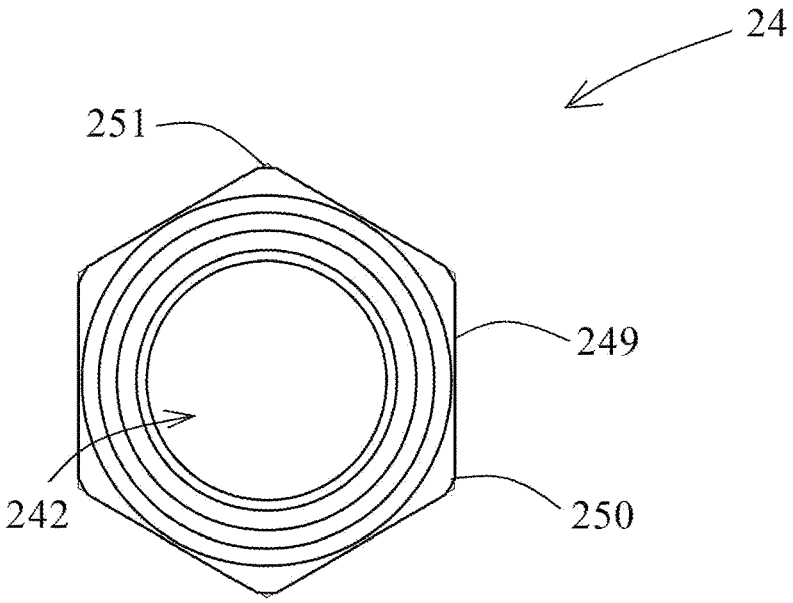
FIG. 8B is a schematic perspective eight view of the yet another alternative nut of FIG. 8A, according to an example embodiment.
Figure 9B:
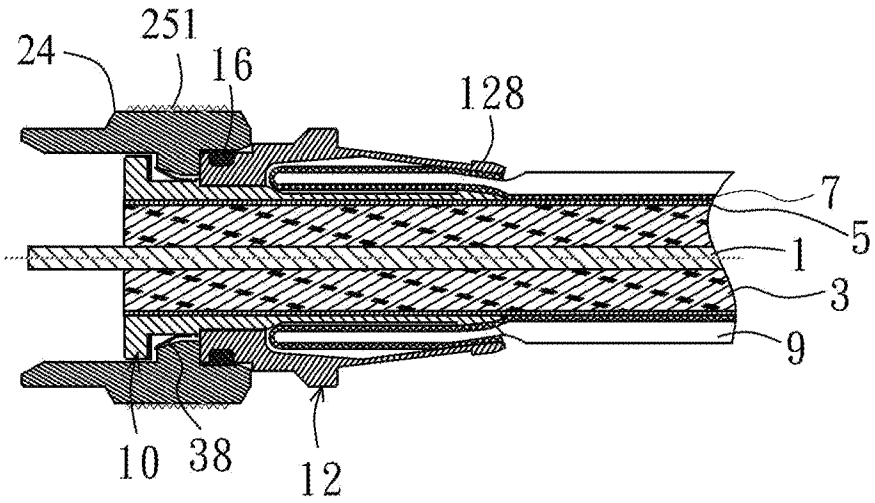
FIG. 9B is a cross-sectional sliced first view of the another alternative coaxial cable connector of FIG. 9A without a sleeve, according to an example embodiment.
Figure 9A:
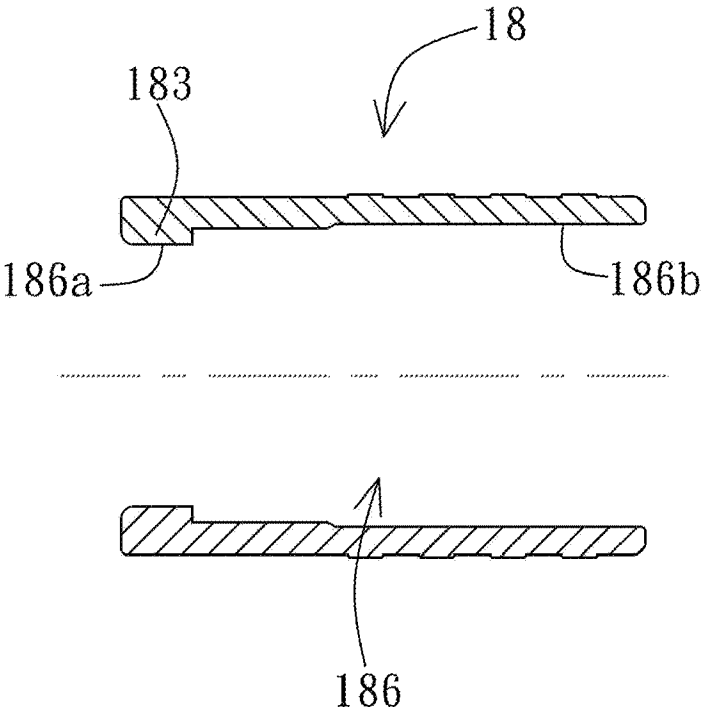
FIG. 9A is a cross-sectional sliced first view of a sleeve of another alternative coaxial cable connector, according to an example embodiment.
Figure 9C:
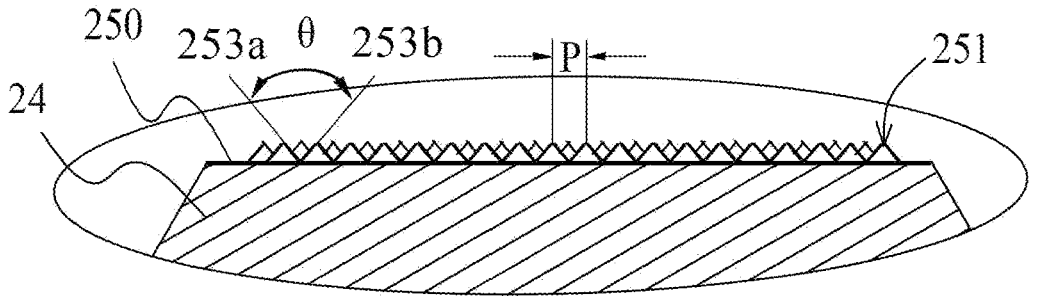
FIG. 9C is a cross-sectional enlarged first view of a raised ridged pattern of the yet another alternative nut of the another alternative coaxial cable connector of FIG. 9B, according to an example embodiment.
Figure 9D:
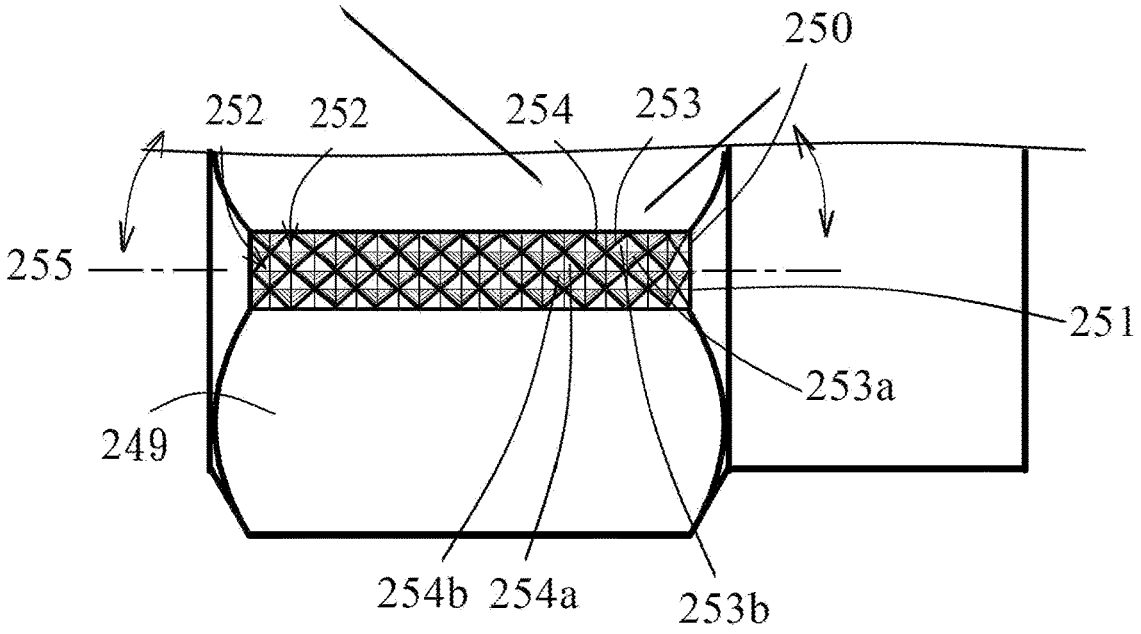
FIG. 9D is a schematic perspective sectional second view of the yet another alternative nut of the another alternative coaxial cable connector of FIG. 9B, according to an example embodiment.
Figure 9E:
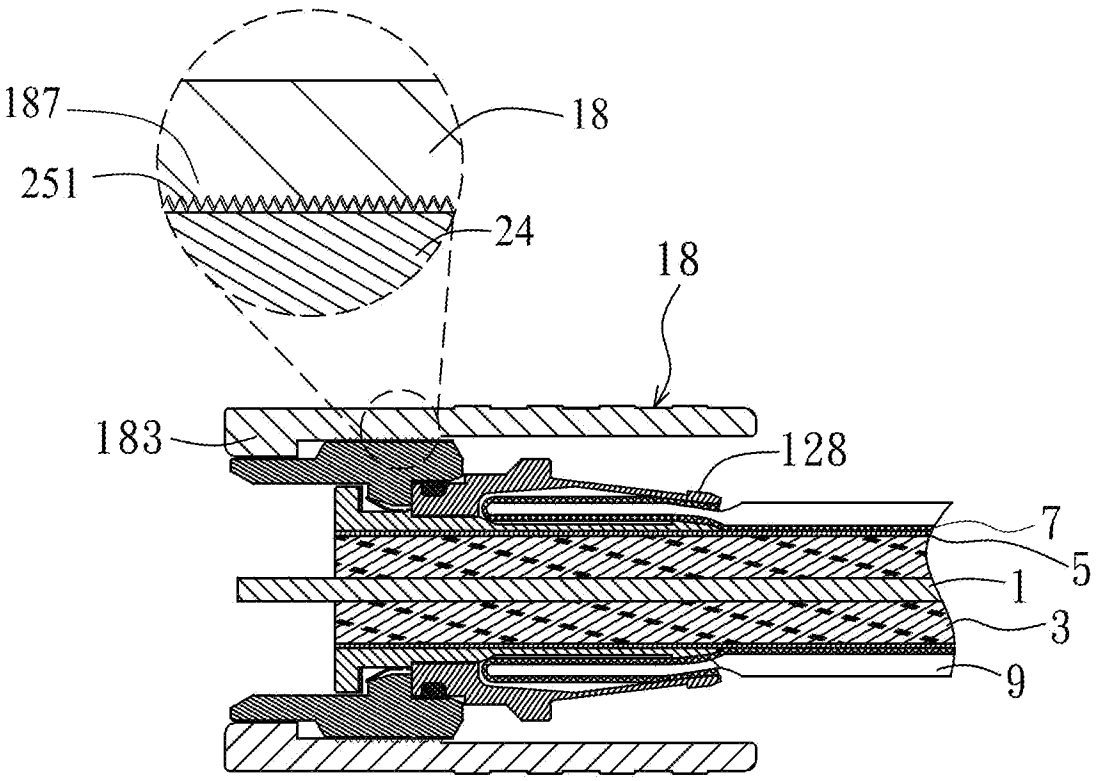
FIG. 9E is a cross-sectional sliced first view of the another alternative coaxial cable connector of FIG. 9B, according to an example embodiment.

FIG. 8A is a schematic perspective second view of the yet another alternative nut of the alternative coaxial cable connector of FIG. 7, according to an example embodiment. FIG. 8B is a schematic perspective eight view of the yet another alternative nut of FIG. 8A, according to an example embodiment. FIG. 9A is a cross-sectional sliced first view of a sleeve of another alternative coaxial cable connector, according to an example embodiment. FIG. 9B is a cross-sectional sliced first view of the another alternative coaxial cable connector of FIG. 9A without a sleeve, according to an example embodiment. FIG. 9C is a cross-sectional enlarged first view of a raised ridged pattern of the yet another alternative nut of the another alternative coaxial cable connector of FIG. 9B, according to an example embodiment. FIG. 9D is a schematic perspective sectional second view of the yet another alternative nut of the another alternative coaxial cable connector of FIG. 9B, according to an example embodiment. FIG. 9E is a cross-sectional sliced first view of the another alternative coaxial cable connector of FIG. 9B, according to an example embodiment. Referring to FIGS. 8A to 9E, and referring to FIGS. 1A to 3 and FIG. 7, in the alternative embodiment, the yet another alternative nut 24 has a plurality of nut sides 249 surrounding a distal nut interior opening 242, opposite a proximal nut interior opening, a plurality of crests 250 between the plurality of nut sides 249, each having a raised ridged pattern thereon, and an annular inward protrusion 244 having a protrusion ridge 245, a tapered protrusion surface 243, and an inner protrusion surface 247. Each raised ridged pattern comprises a first plurality of grooves 253 having a first groove helix angle with respect to a reference plane normal to a longitudinal axis 255 of the plurality of crests 250 and a second plurality of grooves 254 having a second groove helix angle with respect to the reference plane, intersecting the first plurality of grooves 253, defining a plurality of peaks 251.

The yet another alternative nut 24 further comprises a distal nut end portion 248 and a threaded portion 246. The annular inward protrusion 244 is between the distal nut end portion 248 and threaded portion 246.

In the alternative embodiment of the coaxial cable connector, the post 10 is assembled to the nut 24 via the proximal nut interior opening, whereby the proximal post engagement portion 104 is near to the protrusion ridge 245 of the nut 24. The annular flange 12 is assembled to the post 10 and the nut 24 via the proximal flange interior opening of the annular flange 12. The proximal flange engagement end 124 is flush with the annular inward protrusion 244 of the nut 24 and post ridge 106 and post outer surface 110 of the post 10, and an annular space is formed between the proximal flange engagement end 124 and distal flange end 128 of the annular flange 12 and post outer surface 110 and distal post tapered end 112 of the post 10. The nut 24 is assembled to the proximal sleeve interior portion 186*a* of the sleeve 18 via the distal sleeve interior opening 186. In some embodiments, the shape of the distal sleeve interior opening 186 is polygonal-shaped. Following assembly, a plurality of deformed indentations is formed on an inner surface of the sleeve 18 via the plurality of peaks 251 of the nut 24.

The depth, pitch (P), and amount of plurality of peaks, are configured such that the nut 24 may be conveniently slip-on assembled to the sleeve 18 and following deformation of the inner surface of the sleeve 18 via the plurality of peaks 251 of the nut 24, the nut 24 is fixedly gripped and mounted to the sleeve 18, such that unmounting and/or rotational slippage due to, as an example, dynamic stresses or screwing and unscrewing of the coaxial cable connector is hindered. The depth, pitch (P), and amount of plurality of peaks, may be configured such that a greater amount of inner surface deformation is achieved, increasing ploughing friction, resulting in a higher friction value.

In the alternative embodiment of the coaxial cable connector, each of the first and second plurality of grooves 253, 254 of the nut 24 comprise a first groove surface, a second groove surface, and a groove line formed at each respective juncture of the first and second groove surfaces. In an alternative embodiment, the intersections of the first and second plurality of grooves 253, 254 form a plurality of pyramids 252 on each of the plurality of crests 250 of the nut 24, whereby each of the pyramids 252 include first opposed lateral surfaces 253*a* (proximal facing), 253*b* (distal facing) formed by the first groove surfaces and second opposed lateral surfaces 254*a* (proximal facing), 254*b* (distal facing) formed by the second groove surfaces.

In the alternative embodiment of the coaxial cable connector, the sum of the magnitudes of the first and second helix angles of the nut 24 are 90° degrees or less. In some embodiments, the magnitudes of the first and second helix angles of the nut 24 are the same. In some embodiments, the magnitudes of the first and second helix angles of the nut 24 are different. The magnitudes of the first and second helix angles determine the amount of the plurality of peaks 251 of the nut 24 and formation of the plurality of deformed indentations on the inner surface of the sleeve 18. The magnitudes are configured such that a greater amount of inner surface deformation is achieved, increasing ploughing friction, resulting in a higher friction value.

In the alternative embodiment of the coaxial cable connector, the slopes forming included angles (θ) of the first and second opposed lateral surfaces 253*a*, 253*b*, 254*a*, and 254*b* are different, respectively. As an example, and not to be limiting, angles of lateral surfaces relative to nearest surfaces of each of the plurality of crests 250 of the proximal facing first and second opposed lateral surfaces (253*a*, 254*a*) may be greater than those of the distal facing first and second opposed lateral surfaces (253*b*, 254*b*) for greater slip-on convenience assembly of the nut 24 to the sleeve 18 and following deformation of the inner surface of the sleeve 18 via the plurality of peaks 251 of the nut 24, greater fixing and grip mounting to the sleeve 18, whereby unmounting and/or rotational slippage due to, as an example, dynamic stresses or screwing and unscrewing of the coaxial cable connector is hindered.

In some embodiments, the another alternative coaxial cable connector further comprises a fixing washer 30 having a fixing washer ring 35 and a plurality of fixing appendages 36. Each of the plurality of fixing appendages 36 comprises an elastic wing 38 and an opening space 39. The fixing washer 30 is assembled to the proximal post engagement portion 104 and proximal post outer surface 108 of the post 10 via the distal post tapered end 112 and the post 10 and the fixing washer 30 are assembled to the nut 24 via the proximal nut interior opening. The elastic wing 38 of each of the plurality of fixing appendages 36 is in contact with the tapered protrusion surface 143 of the nut 24. In an alternative embodiment, the plurality of fixing appendages 36 are perpendicular to the fixing washer ring 35, and the elastic wing 38 extends from a top portion of each of the plurality of fixing appendages 36 at an outward angle. When the elastic wing 38 of each of the plurality of fixing appendages 36 are in contact with the tapered protrusion surface 143 of the nut 24 and the nut 24 is moved, the outward angle thereof is varied.

In some embodiments, the another alternative coaxial cable connector further comprises an o-ring 16 assembled within the proximal channel 111 of the annular flange 12 for waterproof sealing. When assembled, the o-ring 16 completely encompasses all of the space of the proximal channel 111 of the annular flange 12, and is deformed due the pressure from the distal nut end portion 248 of the nut 24.

In the embodiments, when assembled, a proximal portion of the jacket 9 is removed and the center conductor 1, dielectric 3, and foil shield 5 is inserted into the distal post tapered end 112 of the post 10. The center conductor 1 extends flush with the proximal nut interior opening surrounded by the threaded portion 146 of the nut 14. The dielectric 3 and foil shield 5 lies flush with the proximal post interior opening surrounded by the proximal post engagement portion. During assembly, a lengthier portion of the braided shield 7 is folded backward to cover a portion of the jacket 9 corresponding to the annular space formed between the proximal flange engagement end 124 and distal flange end 128 of the annular flange 12 and post outer surface 110 and distal post tapered end 112 of the post 10, following a force applied to the distal flange end 128 of the annular flange 12 via assembly to the post 10 and nut 14.

Referring to FIGS. 7 to 9E, and referring to FIGS. 1A to 3, in yet another alternative embodiment, the yet another alternative nut 24, configured as a part of the alternative coaxial cable connector, comprising a plurality of nut sides 249, a plurality of crests 250 between the plurality of nut sides 249, and an annular inward protrusion 244 is provided. The plurality of nut sides 249 surround a distal nut interior opening 242, opposite a proximal nut interior opening. Each of the plurality of crests 250 between the plurality of nut sides 249, have a raised ridged pattern thereon. The annular inward protrusion 244 having a protrusion ridge 245, a tapered protrusion surface 243, and an inner protrusion surface 247. Each raised ridged pattern comprises a first plurality of grooves 253 having a first groove helix angle with respect to a reference plane normal to a longitudinal axis 255 of the plurality of crests 250 and a second plurality of grooves 254 having a second groove helix angle with respect to the reference plane, intersecting the first plurality of grooves 253, defining a plurality of peaks 251.

The alternative coaxial cable connector of the yet another alternative nut 24 comprises the sleeve 18, the post 10 and the annular flange 12 of FIGS. 1A to 3. The sleeve 18 has a proximal sleeve engagement portion 183 surrounding a proximal sleeve interior opening and a distal sleeve interior portion 186*b* surrounding a distal sleeve interior opening 186. The proximal sleeve engagement portion 183 comprises a proximal sleeve interior portion 186*a*. The post 10 has a proximal post engagement portion 104 surrounding a proximal post interior opening, proximal post outer surface 108, post ridge 106, post outer surface 110, and distal post tapered end 112 surrounding a distal post interior opening 102. The annular flange 12 has a proximal flange engagement end 124 surrounding a proximal flange interior opening, proximal channel 111, first proximal outer surface 130, second proximal outer surface 132, a central outer annular flange 126, and a distal flange end 128 surrounding a distal flange interior opening 122.

The yet another alternative nut 24 further comprises a distal nut end portion 248 and a threaded portion 246. The annular inward protrusion 244 is between the distal nut end portion 248 and threaded portion 246.

In the yet another alternative embodiment of the nut 24, configured as a part of the alternative coaxial cable connector, the post 10 is assembled to the nut 24 via the proximal nut interior opening, whereby the proximal post engagement portion 104 is near to the protrusion ridge 245 of the nut 24. The annular flange 12 is assembled to the post 10 and the nut 24 via the proximal flange interior opening of the annular flange 12. The proximal flange engagement end 124 is flush with the annular inward protrusion 244 of the nut 24 and post ridge 106 and post outer surface 110 of the post 10, and an annular space is formed between the proximal flange engagement end 124 and distal flange end 128 of the annular flange 12 and post outer surface 110 and distal post tapered end 112 of the post 10. The nut 24 is assembled to the proximal sleeve interior portion 186*a* of the sleeve 18 via the distal sleeve interior opening 186. In some embodiments, the shape of the distal sleeve interior opening 186 is polygonal-shaped. Following assembly, a plurality of deformed indentations is formed on an inner surface of the sleeve 18 via the plurality of peaks 251 of the nut 24.

The depth, pitch (P), and amount of plurality of peaks, are configured such that the nut 24 may be conveniently slip-on assembled to the sleeve 18 and following deformation of the inner surface of the sleeve 18 via the plurality of peaks 251 of the nut 24, the nut 24 is fixedly gripped and mounted to the sleeve 18, such that unmounting and/or rotational slippage due to, as an example, dynamic stresses or screwing and unscrewing of the coaxial cable connector is hindered. The depth, pitch (P), and amount of plurality of peaks, may be configured such that a greater amount of inner surface deformation is achieved, increasing ploughing friction, resulting in a higher friction value.

In the yet another alternative embodiment of the nut 24, configured as a part of the alternative coaxial cable connector, each of the first and second plurality of grooves 253, 254 of the nut 24 comprise a first groove surface, a second groove surface, and a groove line formed at each respective juncture of the first and second groove surfaces. In an alternative embodiment, the intersections of the first and second plurality of grooves 253, 254 form a plurality of pyramids 252 on each of the plurality of crests 250 of the nut 24, whereby each of the pyramids 252 include first opposed lateral surfaces 253*a* (proximal facing), 253*b* (distal facing) formed by the first groove surfaces and second opposed lateral surfaces 254*a* (proximal facing), 254*b* (distal facing) formed by the second groove surfaces.

In the yet another alternative embodiment of the nut 24, configured as a part of the alternative coaxial cable connector, the sum of the magnitudes of the first and second helix angles of the nut 24 are 90° degrees or less. In some embodiments, the magnitudes of the first and second helix angles of the nut 24 are the same. In some embodiments, the magnitudes of the first and second helix angles of the nut 24 are different. The magnitudes of the first and second helix angles determine the amount of the plurality of peaks 251 of the nut 24 and formation of the plurality of deformed indentations on the inner surface of the sleeve 18. The magnitudes are configured such that a greater amount of inner surface deformation is achieved, increasing ploughing friction, resulting in a higher friction value.

In the yet another alternative embodiment of the nut 24, configured as a part of the alternative coaxial cable connector, the slopes forming included angles (θ) of the first and second opposed lateral surfaces 253*a*, 253*b*, 254*a*, 254*b* are different, respectively. As an example, and not to be limiting, angles of lateral surfaces relative to nearest surfaces of each of the plurality of crests 250 of the proximal facing first and second opposed lateral surfaces (253*a*, 254*a*) may be greater than those of the distal facing first and second opposed lateral surfaces (253*b*, 254*b*) for greater slip-on convenience assembly of the nut 24 to the sleeve 18 and following deformation of the inner surface of the sleeve 18 via the plurality of peaks 251 of the nut 24, greater fixing and grip mounting to the sleeve 18, whereby unmounting and/or rotational slippage due to, as an example, dynamic stresses or screwing and unscrewing of the coaxial cable connector is hindered.

In some embodiments of the nut 24, configured as a part of the alternative coaxial cable connector, the alternative coaxial cable connector further comprises a fixing washer 30 having a fixing washer ring 35 and a plurality of fixing appendages 36. Each of the plurality of fixing appendages 36 comprises an elastic wing 38 and an opening space 39. The fixing washer 30 is assembled to the proximal post engagement portion 104 and proximal post outer surface 108 of the post 10 via the distal post tapered end 112 and the post 10 and the fixing washer 30 are assembled to the nut 24 via the proximal nut interior opening. The elastic wing 38 of each of the plurality of fixing appendages 36 is in contact with the tapered protrusion surface 143 of the nut 24. In an alternative embodiment, the plurality of fixing appendages 36 are perpendicular to the fixing washer ring 35, and the elastic wing 38 extends from a top portion of each of the plurality of fixing appendages 36 at an outward angle. When the elastic wing 38 of each of the plurality of fixing appendages 36 are in contact with the tapered protrusion surface 143 of the nut 24 and the nut 24 is moved, the outward angle thereof is varied.

In some embodiments of the nut 24, configured as a part of the alternative coaxial cable connector, the alternative coaxial cable connector further comprises an o-ring 16 assembled within the proximal channel 111 of the annular flange 12 for waterproof sealing. When assembled, the o-ring 16 completely encompasses all of the space of the proximal channel 111 of the annular flange 12, and is deformed due the pressure from the distal nut end portion 248 of the nut 24.

In the embodiments, when assembled, a proximal portion of the jacket 9 is removed and the center conductor 1, dielectric 3, and foil shield 5 is inserted into the distal post tapered end 112 of the post 10. The center conductor 1 extends flush with the proximal nut interior opening surrounded by the threaded portion 146 of the nut 14. The dielectric 3 and foil shield 5 lies flush with the proximal post interior opening surrounded by the proximal post engagement portion. During assembly, a lengthier portion of the braided shield 7 is folded backward to cover a portion of the jacket 9 corresponding to the annular space formed between the proximal flange engagement end 124 and distal flange end 128 of the annular flange 12 and post outer surface 110 and distal post tapered end 112 of the post 10, following a force applied to the distal flange end 128 of the annular flange 12 via assembly to the post 10 and nut 14.

Figure 10:
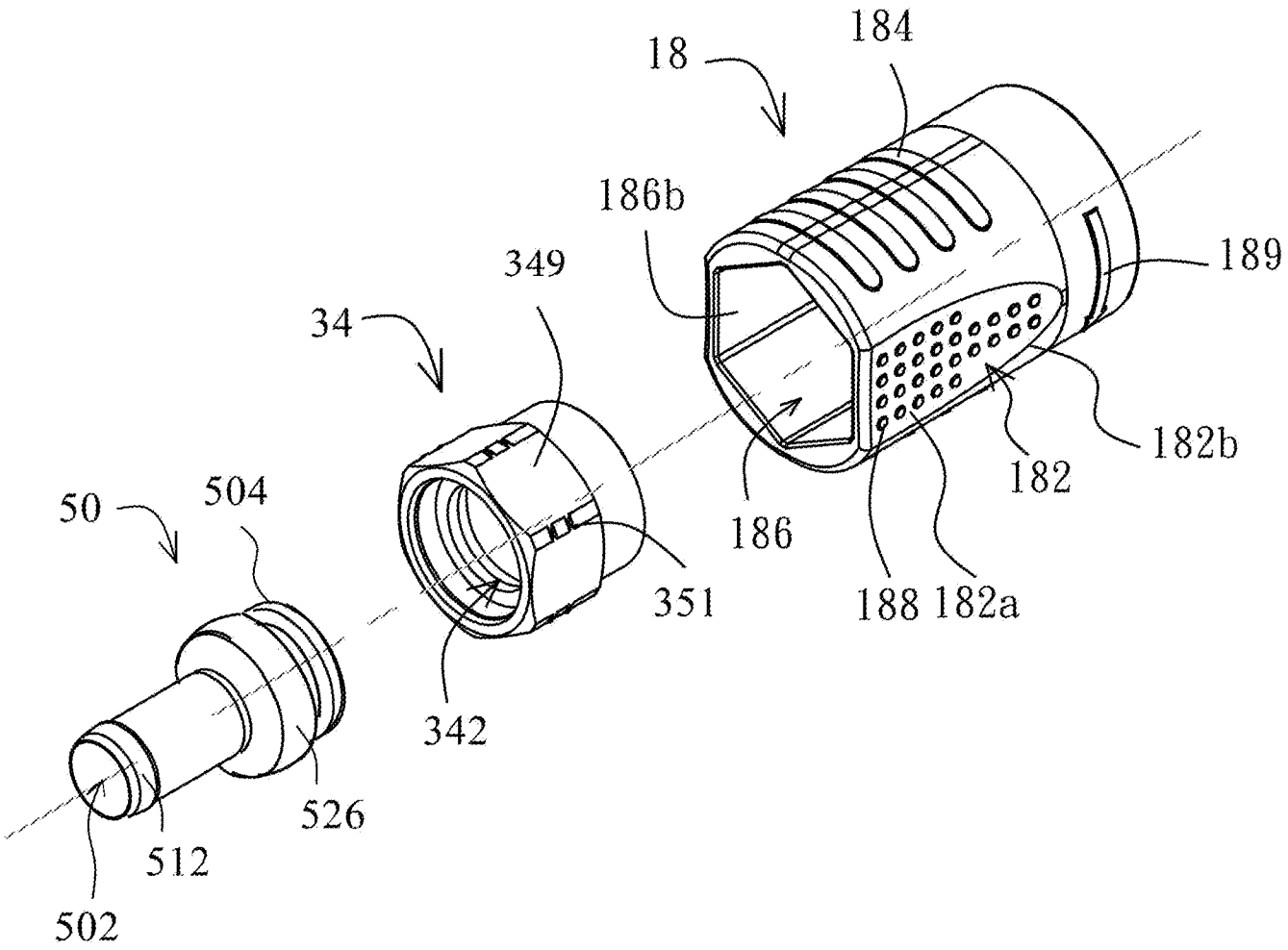
FIG. 10 is an exploded fifth view of another alternative coaxial cable connector, according to an example embodiment.
Figure 11:
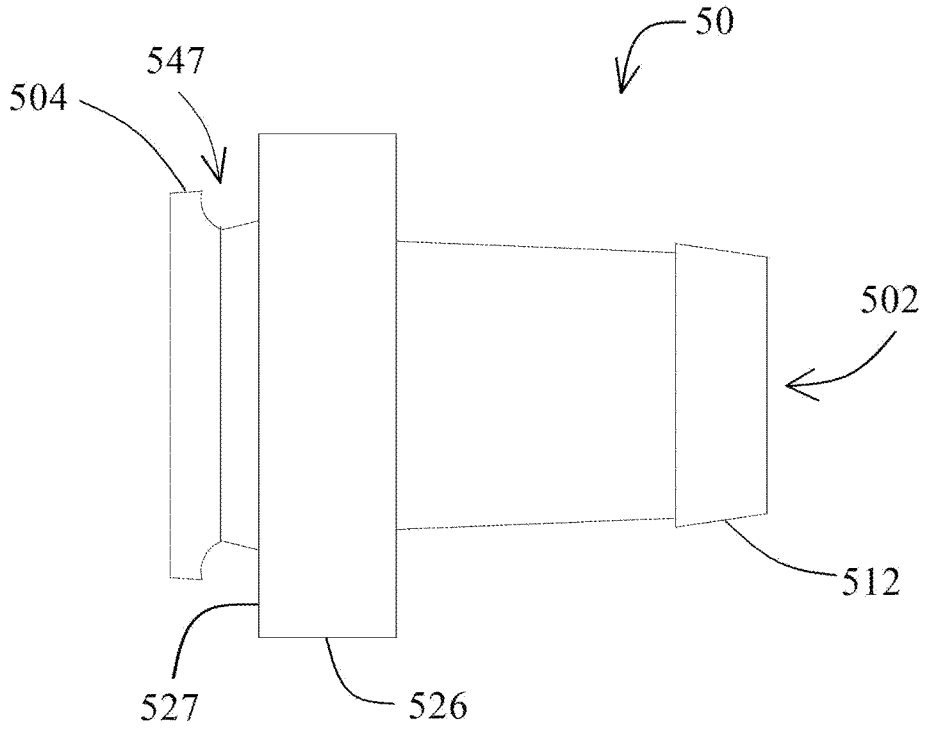
FIG. 11 is a schematic perspective first view of an alternative post of the another alternative coaxial cable connector of FIG. 10, according to an example embodiment.
Figure 12A:
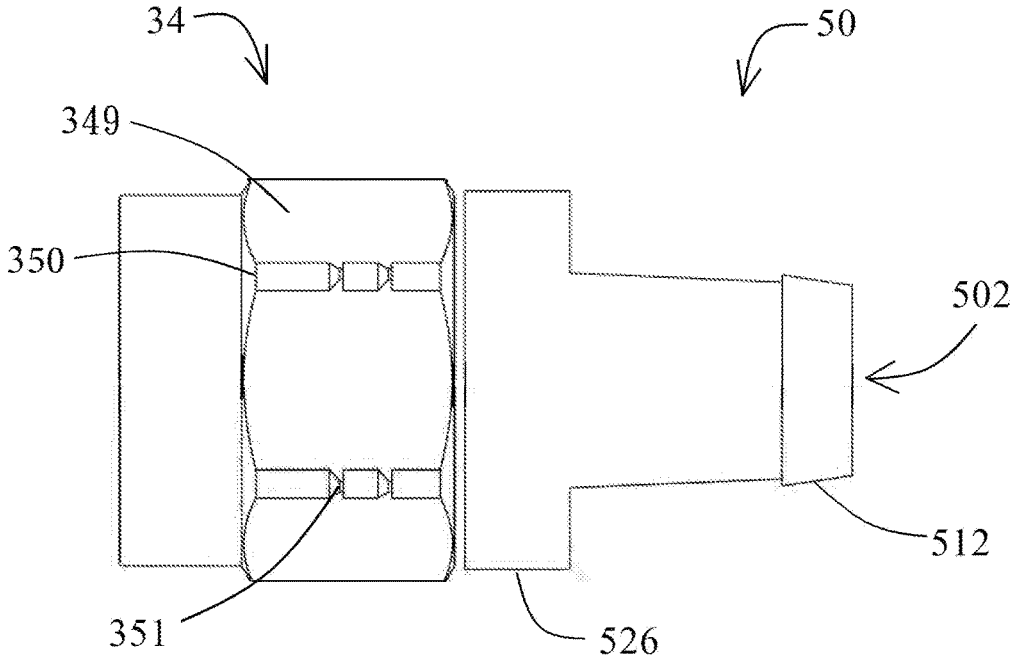
FIG. 12A is a schematic perspective first view of the another alternative coaxial cable connector of FIG. 10 without a sleeve, according to an example embodiment.
Figure 12B:
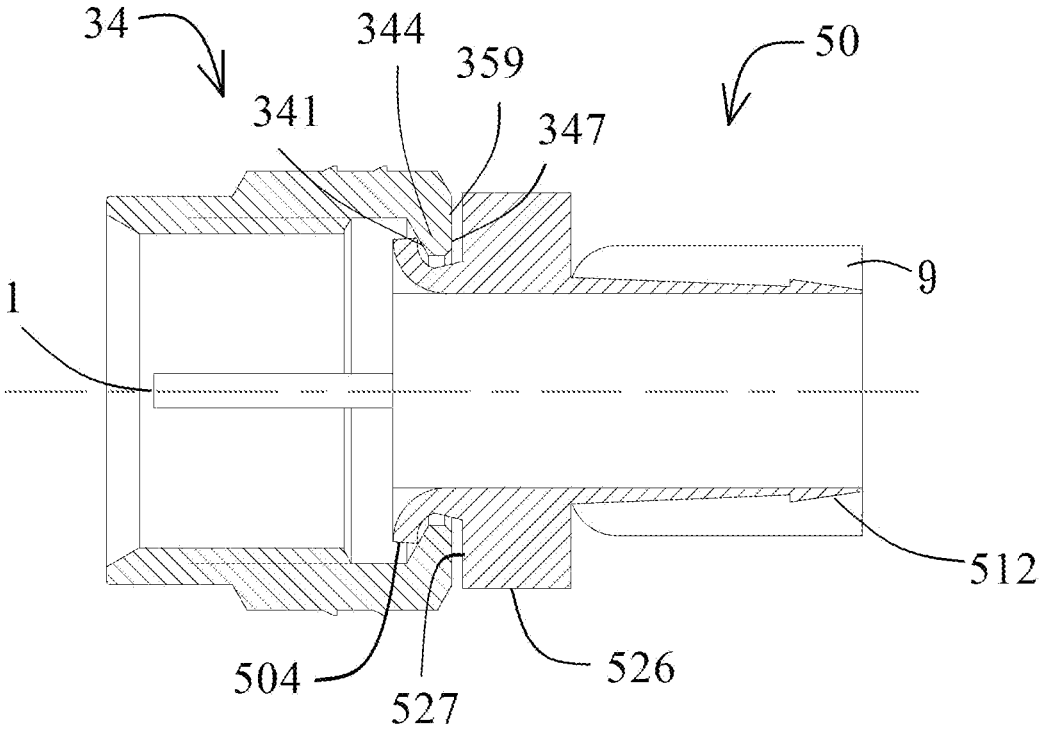
FIG. 12B is a cross-sectional first view of the another alternative coaxial cable connector of FIG. 12A with a coaxial cable, according to an example embodiment.
Figure 13B:
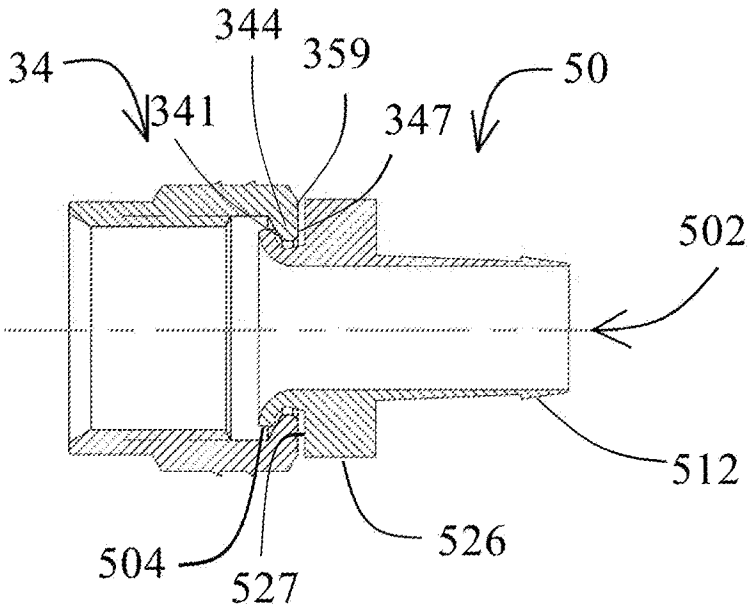
FIG. 13B is a cross-sectional sliced first view of the another alternative coaxial cable connector of FIG. 10 without a sleeve, according to an example embodiment.
Figure 13A:
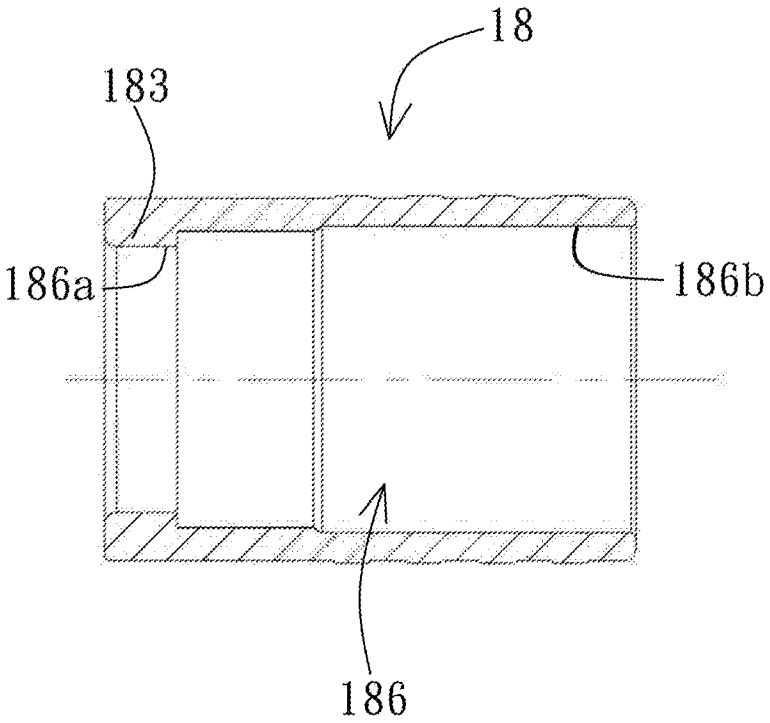
FIG. 13A is a cross-sectional sliced first view of the sleeve of the another alternative coaxial cable connector of FIG. 10, according to an example embodiment.
Figure 13C:
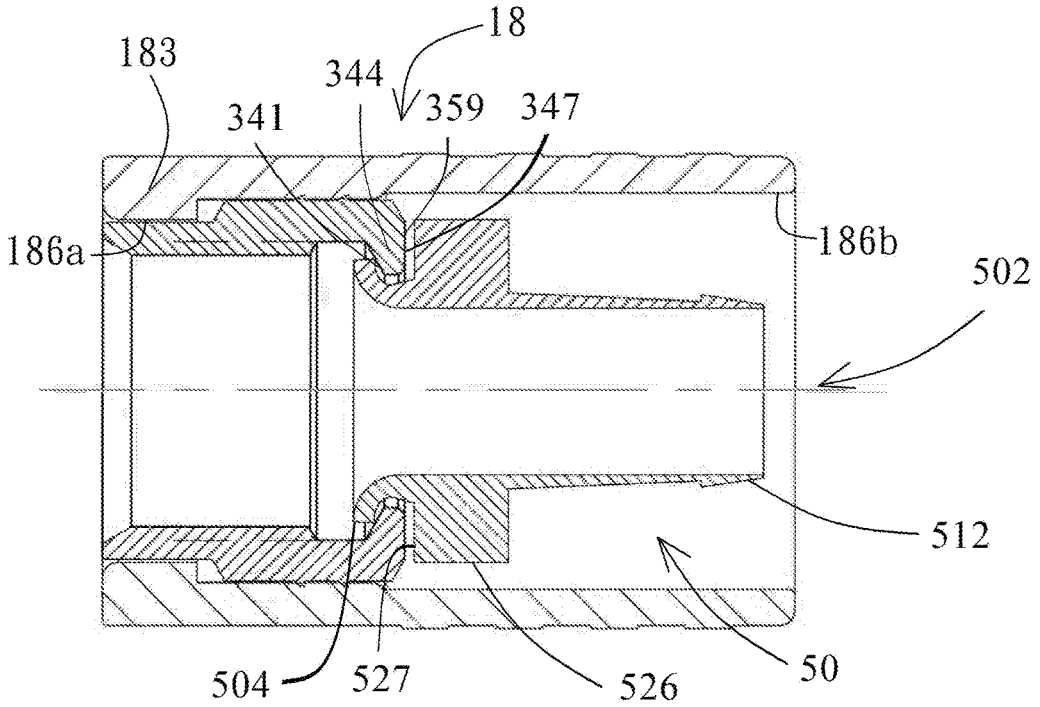
FIG. 13C is a cross-sectional first view of the another alternative coaxial cable connector of FIG. 10, according to an example embodiment.

In some embodiments, the coaxial cable connector further comprises the annular flange 12, the annular flange 12 and fixing washer 30, and the annular flange 12, fixing washer 30 and o-ring 16, respectively; however, the embodiments are not limited thereto. FIG. 10 is an exploded fifth view of another alternative coaxial cable connector, according to an example embodiment. FIG. 11 is a schematic perspective first view of an alternative post of the another alternative coaxial cable connector of FIG. 10, according to an example embodiment. FIG. 12A is a schematic perspective first view of the another alternative coaxial cable connector of FIG. 10 without a sleeve, according to an example embodiment. FIG. 12B is a cross-sectional first view of the another alternative coaxial cable connector of FIG. 12A with a coaxial cable, according to an example embodiment. FIGS. 13A, 13B and 13C are cross-sectional sliced first views of the sleeve of the another alternative coaxial cable connector of FIG. 10, the another alternative coaxial cable connector of FIG. 10 without a sleeve, and the another alternative coaxial cable connector of FIG. 10, according to an example embodiment, respectively. Referring to FIGS. 10 to 13C, and referring to FIGS. 1A to 1D and FIGS. 4A to 4D, in the another alternative embodiment, the coaxial cable connector comprises the sleeve 18, an alternative nut 34, and an alternative post 50 and not the annular flange 12, fixing washer 30 and o-ring 16.

The sleeve 18 has a proximal sleeve engagement portion 183 surrounding a proximal sleeve interior opening and a distal sleeve interior portion 186*b* surrounding a distal sleeve interior opening 186. The proximal sleeve engagement portion 183 comprises a proximal sleeve interior portion 186*a*.

The alternative nut 34 has a plurality of nut sides 349 surrounding a distal nut interior opening 342, opposite a proximal nut interior opening, a plurality of crests 350 between the plurality of nut sides 349, each having a plurality of engagement protrusions 351 thereon, and a distal annular inward protrusion 344 having a proximal inner protrusion shoulder 341, and a distal inner protrusion surface 347 flush with each of the distal nut side surfaces 359. The distal inner protrusion surface 347 and each of the distal nut side surfaces 359 define a distal nut base. Each raised ridged pattern comprises a first plurality of grooves 753 having a first groove helix angle with respect to a reference plane normal to a longitudinal axis 755 of the plurality of crests 750 and a second plurality of grooves 754 having a second groove helix angle with respect to the reference plane, intersecting the first plurality of grooves 753, defining a plurality of peaks 751. Each of the plurality of engagement protrusions 351 comprise a tapered side 351*a* and a distal side 351*b*, the tapered side 351*a*, positioned toward the proximal nut interior opening, has an outer angle D that is greater than an outer angle E of the distal side 351*b*.

In the another alternative embodiment of the coaxial cable connector, the outer angle D of the tapered side 351*a* of the plurality of engagement protrusions 351, positioned toward the proximal nut interior opening, may be between 90° degrees to 160° degrees, between 105° degrees to 170° degrees, between 120° degrees to 150° degrees, and between 110° degrees to 150° degrees, inclusive, respectfully. The outer angle E of the distal side 351*b* of the plurality of engagement protrusions 351 may be between 0° degrees to 90° degrees, between 20° degrees to 80° degrees, between 30° degrees to 60° degrees, and between 40° degrees to 60° degrees, inclusive, respectfully.

The alternative nut 34 further comprises a threaded portion 346 surrounding the proximal nut interior opening.

The alternative post 50 has a proximal post engagement portion 547 surrounding a proximal post interior opening, a distal post tapered end 512 surrounding a distal post interior opening 502, and a proximal annular outward protrusion 526 between the proximal post engagement portion 547 and distal post tapered end 512. The proximal annular outward protrusion 526 has a proximal outward protrusion shoulder 527.

In the another alternative embodiment of the coaxial cable connector, the alternative post 50 is assembled to the alternative nut 34 via the distal nut interior opening 342. A diameter of the distal nut interior opening 342 is greater than a diameter of the proximal post engagement portion 547, but smaller than an outer surface diameter of the outer proximal annular outward protrusion 526. The proximal outward protrusion shoulder 527 is flush with the distal nut base and the proximal post engagement portion 547 extends further than a reference plane normal to the proximal inner protrusion shoulder 341, wherein the proximal post engagement portion 547 is annularly outwardly bent forming a proximal post rolled rim 504. The distal annular inward protrusion 344 of the nut 34 is between the proximal post rolled rim 504 and proximal annular outward protrusion 526 of the post 50. The nut 34 is assembled to the proximal sleeve interior portion 186*a* of the sleeve 18 via the distal sleeve interior opening 186. In some embodiments, the shape of the distal sleeve interior opening 186 is polygonal-shaped. Following assembly, a plurality of deformed indentations is formed on an inner surface of the sleeve 18 via the plurality of engagement protrusions of the nut 34.

In some embodiments, when assembled, a proximal portion of the jacket 9 is removed and the center conductor 1, dielectric 3, and foil shield 5 is inserted into the distal post tapered end 512 of the post 50. The center conductor 1 extends flush with the proximal nut interior opening surrounded by the threaded portion 746 of the nut 74.

Figure 14:
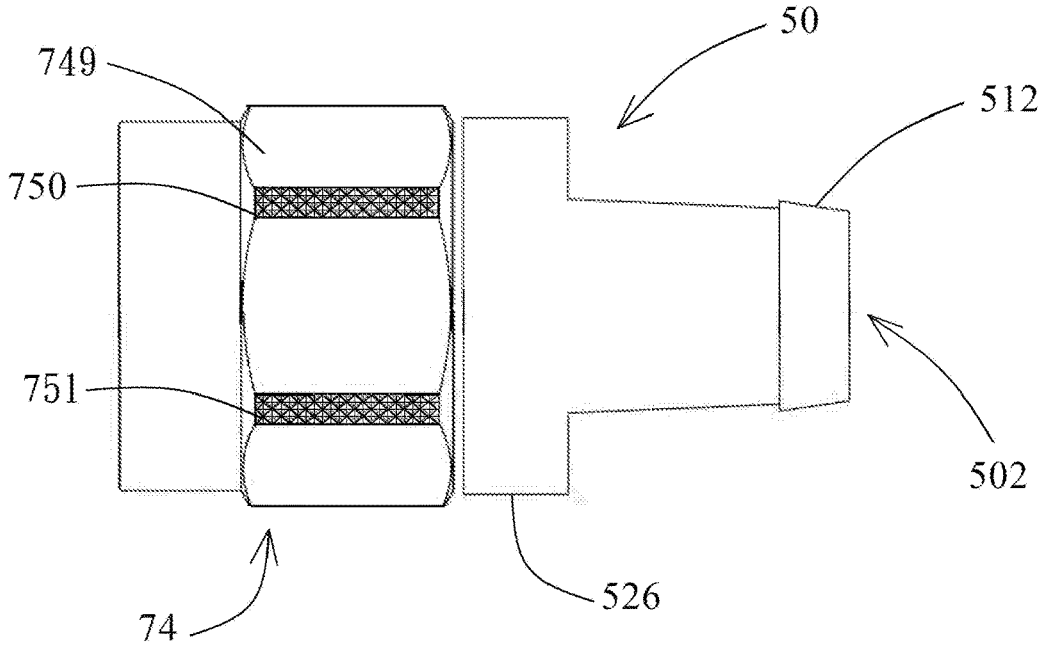
FIG. 14 is a schematic perspective first view of yet another alternative coaxial cable connector without a sleeve, according to an example embodiment.

FIG. 14 is a schematic perspective first view of yet another alternative coaxial cable connector without a sleeve, according to an example embodiment. Referring to FIG. 14, and referring to FIGS. 10 to 13C and FIGS. 8A, 8B, 9C and 9D, in the yet another alternative embodiment, the coaxial cable connector comprises the sleeve 18 and the alternative post 50 of FIGS. 10 to 13C, and the another alternative nut 74 of FIGS. 8A, 8B, 9C and 9D.

The sleeve 18 has a proximal sleeve engagement portion 183 surrounding a proximal sleeve interior opening and a distal sleeve interior portion 186*b* surrounding a distal sleeve interior opening 186. The proximal sleeve engagement portion 183 comprises a proximal sleeve interior portion 186*a*.

The another alternative nut 74 has a plurality of nut sides 749 surrounding a distal nut interior opening 742, opposite a proximal nut interior opening, a plurality of crests 750 between the plurality of nut sides 749, each having a raised ridged pattern thereon, and a distal annular inward protrusion 744 having a proximal inner protrusion shoulder 741, and a distal inner protrusion surface 747 flush with each of the distal nut side surfaces 759. The distal inner protrusion surface 747 and each of the distal nut side surfaces 759 define a distal nut base. Each raised ridged pattern comprises a first plurality of grooves 753 having a first groove helix angle with respect to a reference plane normal to a longitudinal axis 755 of the plurality of crests 750 and a second plurality of grooves 754 having a second groove helix angle with respect to the reference plane, intersecting the first plurality of grooves 753, defining a plurality of peaks 751.

The another alternative nut 74 further comprises a threaded portion 746 surrounding the proximal nut interior opening.

The alternative post 50 has a proximal post engagement portion 547 surrounding a proximal post interior opening, a distal post tapered end 512 surrounding a distal post interior opening 502, and a proximal annular outward protrusion 526 between the proximal post engagement portion 547 and distal post tapered end 512. The proximal annular outward protrusion 526 has a proximal outward protrusion shoulder 527.

In the yet another alternative embodiment of the coaxial cable connector, the alternative post 50 is assembled to the nut 74 via the distal nut interior opening 742. A diameter of the distal nut interior opening 742 is greater than a diameter of the proximal post engagement portion 547, but smaller than an outer surface diameter of the outer proximal annular outward protrusion 526. The proximal outward protrusion shoulder 527 is flush with the distal nut base and the proximal post engagement portion 547 extends further than a reference plane normal to the proximal inner protrusion shoulder 741, wherein the proximal post engagement portion 547 is annularly outwardly bent forming a proximal post rolled rim 504. The distal annular inward protrusion 744 of the nut 74 is between the proximal post rolled rim 504 and proximal annular outward protrusion 526 of the post 50. The nut 74 is assembled to the proximal sleeve interior portion 186*a* of the sleeve 18 via the distal sleeve interior opening 186. In some embodiments, the shape of the distal sleeve interior opening 186 is polygonal-shaped. Following assembly, a plurality of deformed indentations is formed on an inner surface of the sleeve 18 via the plurality of engagement protrusions of the nut 74.

The depth, pitch (P), and amount of plurality of peaks, are configured such that the nut 74 may be conveniently slip-on assembled to the sleeve 18 and following deformation of the inner surface of the sleeve 18 via the plurality of peaks 751 of the nut 74, the nut 74 is fixedly gripped and mounted to the sleeve 18, such that unmounting and/or rotational slippage due to, as an example, dynamic stresses or screwing and unscrewing of the coaxial cable connector is hindered. The depth, pitch (P), and amount of plurality of peaks, may be configured such that a greater amount of inner surface deformation is achieved, increasing ploughing friction, resulting in a higher friction value.

In the yet another alternative embodiment of the coaxial cable connector, each of the first and second plurality of grooves 753, 754 of the nut 74 comprise a first groove surface, a second groove surface, and a groove line formed at each respective juncture of the first and second groove surfaces. In an alternative embodiment, the intersections of the first and second plurality of grooves 753, 754 form a plurality of pyramids 752 on each of the plurality of crests 750 of the nut 74, whereby each of the pyramids 752 include first opposed lateral surfaces 753*a* (proximal facing), 753*b* (distal facing) formed by the first groove surfaces and second opposed lateral surfaces 754*a* (proximal facing), 754*b* (distal facing) formed by the second groove surfaces.

In the yet another alternative embodiment of the coaxial cable connector, the sum of the magnitudes of the first and second helix angles of the nut 74 are 90° degrees or less. In some embodiments, the magnitudes of the first and second helix angles of the nut 74 are the same. In some embodiments, the magnitudes of the first and second helix angles of the nut 74 are different. The magnitudes of the first and second helix angles determine the amount of the plurality of peaks 751 of the nut 74 and formation of the plurality of deformed indentations on the inner surface of the sleeve 18. The magnitudes are configured such that a greater amount of inner surface deformation is achieved, increasing ploughing friction, resulting in a higher friction value.

In some embodiments, the slopes forming included angles (8) of the first and second opposed lateral surfaces 753*a*, 753*b*, 754*a*, and 754*b* are different, respectively. As an example, and not to be limiting, angles of lateral surfaces relative to nearest surfaces of each of the plurality of crests 750 of the proximal facing first and second opposed lateral surfaces (753*a*, 754*a*) may be greater than those of the distal facing first and second opposed lateral surfaces (753*b*, 754*b*) for greater slip-on convenience assembly of the nut 74 to the sleeve 18 and following deformation of the inner surface of the sleeve 18 via the plurality of peaks 751 of the nut 74, greater fixing and grip mounting to the sleeve 18, whereby unmounting and/or rotational slippage due to, as an example, dynamic stresses or screwing and unscrewing of the coaxial cable connector is hindered.

In some embodiments, when assembled, a proximal portion of the jacket 9 is removed and the center conductor 1, dielectric 3, and foil shield 5 is inserted into the distal post tapered end 512 of the post 50. The center conductor 1 extends flush with the proximal nut interior opening surrounded by the threaded portion 746 of the nut 74.

In the embodiments, the material of the nut 14, 24, 34, 74, post 10, 50, fixing washer 30, and annular flange 12 may comprise electrically conductive material such as copper, bismuth, silver, nickel, tin, gold, copper gold-alloy, copper tin-alloy, copper nickel-alloy, or good electrically conductive polymer, or non-metal conductor etc. The surface of the nut 14, 24, 34, 74, post 10, 50, fixing washer 30, and annular flange 12, may be covered with an antirust layer or have an electroless plating process performed thereto. The material of the sleeve 18 may comprise rubber material, or soft polymaterial, or other elastic and waterproof sealing polymaterial etc.

In the embodiments, the shape of each of the plurality of crests is quadrilateral shaped and the dimensions thereof are between 0.51 to 0.57 millimetres (width), inclusive, and 4.88 to 5.48 millimetres (longitudinal length), inclusive. In some embodiments, the width and longitudinal length are 0.54 and 5.18 mm, respectively. Those of ordinary skill in the relevant art may readily appreciate that the dimensions of the plurality of crests may vary dependent upon requirements, so long as the shape and dimensions of the outside of the nut correspond to the shape and dimensions of proximal sleeve interior portion 186*a* of the sleeve 18 and the nut is configured to be fixedly gripped and mounted thereto, whereby a plurality of deformed indentations is formed on an inner surface of the sleeve 18, such that unmounting and/or rotational slippage due to, as an example, dynamic stresses or screwing and unscrewing of the coaxial cable connector is hindered.

Conventional coaxial cable connectors generally comprise a connector body having a post which is able to house a coaxial cable therethrough, a nut, rotatably coupled to the post, mounting the conventional coaxial cable connector to a rack, casing, apparatus or device having a mounting means built therein, and an annular flange, between the post and nut.

The coaxial cable connectors may further comprise a sleeve, for securing the coaxial cable positioned within the connector body of the conventional coaxial cable connector to the interface port. The sleeve is basically formed of an elastic plastic material and is slidably engaged to the connector body of the coaxial cable connector. However, often the coaxial cable connectors are not properly mounted to the interface port.

Over time, the coaxial cable connectors may not fully engage with and be tightened to the interface port. Thus, proper electrical mating of connector components with the interface port would not occur. After tightening, the coaxial cable connector may undergo complete or partial pretension loss caused by dynamic stresses resulting in the loosening or relative movements resulting in the unscrewing from the interface port, causing loss of component abutment and proper electrical mating.

The coaxial cable connectors may be over-tightened to the interface port. Thus, proper electrical mating of connector components with the interface port would also not occur. After being over-tightened, electrical mating may be faulty because the connector components are caused to yield and/or move out of proper physical connection with the interface port. This is generally more common for the coaxial cable connectors not having o-rings placed between the post and nut at rotatable portions therebetween, where waterproof sealing may not be required for the coaxial cable connectors being used indoors.

In the embodiments, a coaxial cable connector comprising a sleeve, nut, post, and annular flange is provided. The post is assembled to the nut, the annular flange to the post, and post, annular flange and nut to the sleeve. The nut has a plurality of nut sides, and a plurality of crests between the plurality of nut sides, each having a raised ridged pattern thereon. Each raised ridged pattern comprises a first plurality of grooves having a first groove helix angle and a second plurality of grooves having a second groove helix angle, intersecting the first plurality of grooves, forming a plurality of peaks. Following assembly, a plurality of deformed indentations is formed on an inner surface of the sleeve via the plurality of peaks of the nut.

The embodiments provide a coaxial cable connector, comprising a sleeve, a post, an annular flange, and a nut. The post is assembled to the nut, the annular flange is assembled to the post and nut, and the nut, annular flange and post is assembled to the sleeve. The sleeve is made of elastic material and configured for easy and convenient gripping, whereby the shape and dimensions of the outside of the nut correspond to the shape and dimensions of the inside of the sleeve. Thus, the nut of the coaxial cable connector is easily rotated by the sleeve, by, as an example, a persons' fingers. Also, the elasticity of the sleeve increases torque tightening efficiency, thus, allowing the coaxial cable connector to be fully engaged with and be tightened to interface ports of racks, casings, apparatuses or devices, while mitigating over-tightening thereto. Furthermore, the nut comprises a plurality of crests, and each has a raised ridged pattern thereon, forming pyramids, whereby each pyramid has a peak. A depth, pitch (P), and amount of the peaks, are configured such that the nut is conveniently slip-on assembled to the sleeve, forming a plurality of deformed indentations on an inner surface thereof via the nut. The depth, pitch (P), and amount of plurality of peaks, are configured such that a greater amount of inner surface deformation is achieved, increasing ploughing friction, resulting in a higher friction value. Thus, the nut is fixedly gripped and mounted to the sleeve, such that unmounting and/or rotational slippage due to, as an example, dynamic stresses or screwing and unscrewing of the coaxial cable connector is hindered. Accordingly, proper electrical mating of connector components with interface ports of racks, casings, apparatuses or devices is ensured.

The presently disclosed inventive concepts are not intended to be limited to the embodiments shown herein, but are to be accorded their full scope consistent with the principles underlying the disclosed concepts herein. Directions and references to an element, such as "up," "down,", "upper," "lower," "horizontal," "vertical," "left," "right," and the like, do not imply absolute relationships, positions, and/or orientations. Terms of an element, such as "first" and "second" are not literal, but, distinguishing terms. As used herein, terms "comprises" or "comprising" encompass the notions of "including" and "having" and specify the presence of elements, operations, and/or groups or combinations thereof and do not imply preclusion of the presence or addition of one or more other elements, operations and/or groups or combinations thereof. Sequence of operations do not imply absoluteness unless specifically so stated. Reference to an element in the singular, such as by use of the article "a" or "an", is not intended to mean "one and only one" unless specifically so stated, but rather "one or more". As used herein, "and/or" means "and" or "or", as well as "and" and "or." As used herein, ranges and subranges mean all ranges including whole and/or fractional values therein and language which defines or modifies ranges and subranges, such as "at least," "greater than," "less than," "no more than," and the like, mean subranges and/or an upper or lower limit. All structural and functional equivalents to the elements of the various embodiments described throughout the disclosure that are known or later come to be known to those of ordinary skill in the relevant art are intended to be encompassed by the features described and claimed herein. Moreover, nothing disclosed herein is intended to be dedicated to the public regardless of whether such disclosure may ultimately explicitly be recited in the claims. No element or concept disclosed herein or hereafter presented shall be construed under the provisions of 35 USC 112(f) unless the element or concept is expressly recited using the phrase "means for" or "step for".

In view of the many possible embodiments to which the disclosed principles can be applied, we reserve the right to claim any and all combinations of features and acts described herein, including the right to claim all that comes within the scope and spirit of the foregoing description, as well as the combinations recited, literally and equivalently, in the following claims and any claims presented anytime throughout prosecution of this application or any application claiming benefit of or priority from this application.

What is claimed is:

1. A coaxial cable connector, comprising:

a sleeve having a proximal sleeve engagement portion surrounding a proximal sleeve interior opening and a distal sleeve interior portion surrounding a distal sleeve interior opening, wherein the proximal sleeve engagement portion comprises a proximal sleeve interior portion;

a nut having a plurality of nut sides surrounding a distal nut interior opening, opposite a proximal nut interior opening, a plurality of crests between the plurality of nut sides, each having a raised ridged pattern thereon, and an annular inward protrusion having a protrusion ridge, a tapered protrusion surface, and an inner protrusion surface, wherein each raised ridged pattern comprises a first plurality of grooves having a first groove helix angle with respect to a reference plane normal to a longitudinal axis of the plurality of crests and a second plurality of grooves having a second groove helix angle with respect to the reference plane, intersecting the first plurality of grooves, forming a plurality of peaks;

a post having a proximal post engagement portion surrounding a proximal post interior opening, proximal post outer surface, post ridge, post outer surface, and distal post tapered end surrounding a distal post interior opening; and an annular flange having a proximal flange engagement end surrounding a proximal flange interior opening, proximal channel, first proximal outer surface, second proximal outer surface, a central outer annular flange, and a distal flange end surrounding a distal flange interior opening, whereby the post is assembled to the nut via the proximal nut interior opening, whereby the proximal post engagement portion is near to the protrusion ridge of the nut, and the annular flange is assembled to the post and the nut via the proximal flange interior opening of the annular flange, whereby the proximal flange engagement end is flush with the annular inward protrusion of the nut and post ridge and post outer surface of the post, and an annular space is formed between the proximal flange engagement end and distal flange end of the annular flange and post outer surface and distal post tapered end of the post, and whereby the nut is assembled to the proximal sleeve interior portion of the sleeve via the distal sleeve interior opening, and following assembly, a plurality of deformed indentations is formed on an inner surface of the sleeve via the plurality of peaks of the nut.

2. The coaxial cable connector of claim 1, wherein the sum of the magnitudes of the first and second helix angles of the nut are less than 90° degrees, inclusive.

3. The coaxial cable connector of claim 1, wherein the magnitudes of the first and second helix angles of the nut are the same.

4. The coaxial cable connector of claim 1, wherein the magnitudes of the first and second helix angles of the nut are different.

5. The coaxial cable connector of claim 1, wherein each of the first and second plurality of grooves of the nut comprise a first groove surface, a second groove surface, and a groove line formed at each respective juncture of the first and second groove surfaces.

6. The coaxial cable connector of claim 5, wherein the intersections of the first and second plurality of grooves form a plurality of pyramids on each of the plurality of crests of the nut, whereby each of the pyramids include first opposed side surfaces formed by the first groove surfaces and second opposed side surfaces formed by the second groove surfaces.

7. The coaxial cable connector of claim 1, further comprising:

a fixing washer having a fixing washer ring and a plurality of fixing appendages, wherein each of the plurality of fixing appendages comprises an elastic wing and an opening space, wherein the fixing washer is assembled to the proximal post engagement portion and proximal post outer surface of the post via the distal post tapered end, and the elastic wing of each of the plurality of fixing appendages is in contact with the tapered protrusion surface of the nut.

8. The coaxial cable connector of claim 7, wherein the plurality of fixing appendages are perpendicular to the fixing washer ring, and the elastic wing extends from a top portion of each of the plurality of fixing appendages at an outward angle, whereby when the elastic wing of each of the plurality of fixing appendages are in contact with the tapered protrusion surface of the nut and the nut is moved, the outward angle thereof is varied.

9. The coaxial cable connector of claim 1, wherein the shape of the distal sleeve interior opening is polygonal-shaped.

10. A nut, configured as a part of a coaxial cable connector, comprising:

a plurality of nut sides surrounding a distal nut interior opening, opposite a proximal nut interior opening;

a plurality of crests between the plurality of nut sides, each having a raised ridged pattern thereon; and an annular inward protrusion having a protrusion ridge, a tapered protrusion surface, and an inner protrusion surface, wherein each raised ridged pattern comprises a first plurality of grooves having a first groove helix angle with respect to a reference plane normal to a longitudinal axis of the plurality of crests and a second plurality of grooves having a second groove helix angle with respect to the reference plane, intersecting the first plurality of grooves, forming a plurality of peaks, wherein the coaxial cable connector further comprises:

a sleeve having a proximal sleeve engagement portion surrounding a proximal sleeve interior opening and a distal sleeve interior portion surrounding a distal sleeve interior opening, wherein the proximal sleeve engagement portion comprises a proximal sleeve interior portion;

a post having a proximal post engagement portion surrounding a proximal post interior opening, proximal post outer surface, post ridge, post outer surface, and distal post tapered end surrounding a distal post interior opening; and an annular flange having a proximal flange engagement end surrounding a proximal flange interior opening, proximal channel, first proximal outer surface, second proximal outer surface, a central outer annular flange, and a distal flange end surrounding a distal flange interior opening, wherein the post is assembled to the nut via the proximal nut interior opening, whereby the proximal post engagement portion is near to the protrusion ridge of the nut, and the annular flange is assembled to the post and the nut via the proximal flange interior opening of the annular flange, whereby the proximal flange engagement end is flush with the annular inward protrusion of the nut and post ridge and post outer surface of the post, and an annular space is formed between the proximal flange engagement end and distal flange end of the annular flange and post outer surface and distal post tapered end of the post, wherein the nut is assembled to the proximal sleeve interior portion of the sleeve via the distal sleeve interior opening, and following assembly, a plurality of deformed indentations is formed on an inner surface of the sleeve via the plurality of peaks of the nut.

11. The nut, configured as a part of a coaxial cable connector of claim 10, wherein the sum of the magnitudes of the first and second helix angles of the nut are less than 90 degrees, inclusive.

12. The nut, configured as a part of a coaxial cable connector of claim 10, wherein the magnitudes of the first and second helix angles of the nut are the same.

13. The nut, configured as a part of a coaxial cable connector of claim 10, wherein the magnitudes of the first and second helix angles of the nut are different.

14. The nut, configured as a part of a coaxial cable connector of claim 10, wherein each of the first and second plurality of grooves of the nut comprise a first groove surface, a second groove surface, and a groove line formed at each respective juncture of the first and second groove surfaces.

15. The nut, configured as a part of a coaxial cable connector of claim 14, wherein the intersection of each of the first and second plurality of grooves form a plurality of pyramids on each of the plurality of crests of the nut, whereby each of the pyramids include first opposed side surfaces formed by the first groove surfaces and second opposed side surfaces formed by the second groove surfaces.

16. The nut, configured as a part of a coaxial cable connector of claim 10, wherein the coaxial cable connector further comprises:

a fixing washer having a fixing washer ring and a plurality of fixing appendages, wherein each of the plurality of fixing appendages comprises an elastic wing and an opening space, wherein the fixing washer is assembled to the proximal post engagement portion and proximal post outer surface of the post via the distal post tapered end, and the elastic wing of each of the plurality of fixing appendages is in contact with the tapered protrusion surface of the nut.

17. The nut, configured as a part of a coaxial cable connector of claim 16, wherein the plurality of fixing appendages of the fixing washer are perpendicular to the fixing washer ring, and the elastic wing extends from a top portion of each of the plurality of fixing appendages at an outward angle, whereby when the elastic wing of each of the plurality of fixing appendages are in contact with the tapered protrusion surface of the nut and the nut is moved, the outward angle thereof is varied.

18. The nut, configured as a part of a coaxial cable connector of claim 10, wherein the shape of the distal sleeve interior opening is polygonal-shaped.

19. A coaxial cable connector, comprising:

a sleeve having a proximal sleeve engagement portion surrounding a proximal sleeve interior opening and a distal sleeve interior portion surrounding a distal sleeve interior opening, wherein the proximal sleeve engagement portion comprises a proximal sleeve interior portion;

a nut having a plurality of nut sides surrounding a distal nut interior opening, opposite a proximal nut interior opening, each plurality of nut sides having ends forming a distal nut side surface, a plurality of engagement protrusions between the plurality of nut sides, and a distal annular inward protrusion having a proximal inner protrusion shoulder, an inner protrusion surface, and a distal inner protrusion surface flush with each of the distal nut side surfaces, the distal inner protrusion surface and each of the distal nut side surfaces defining a distal nut base, wherein each of the plurality of engagement protrusions comprise a tapered side and a distal side, the tapered side, positioned toward the proximal nut interior opening, having an outer angle that is greater than an outer angle of the distal side; and a post having a proximal post engagement portion surrounding a proximal post interior opening, a distal post tapered end surrounding a distal post interior opening, and a proximal annular outward protrusion between the proximal post engagement portion and distal post tapered end, the proximal annular outward protrusion having a proximal outward protrusion shoulder, whereby the post is assembled to the nut via the distal nut interior opening, the proximal outward protrusion shoulder flush with the distal nut base and the proximal post engagement portion extending further than a reference plane normal to the proximal inner protrusion shoulder, wherein the proximal post engagement portion is annularly outwardly bent forming a proximal post rolled rim, whereby the distal annular inward protrusion of the nut is between the proximal post rolled rim and proximal annular outward protrusion of the post, and whereby the nut is assembled to the proximal sleeve interior portion of the sleeve via the distal sleeve interior opening, and following assembly, a plurality of deformed indentations is formed on an inner surface of the sleeve via the plurality of engagement protrusions of the nut.

20. The coaxial cable connector of claim 19, wherein the angle of the tapered side of the plurality of engagement protrusions is between 105° degrees and 170° degrees, inclusive.

* * * * *